US007789820B2

(12) United States Patent
Akers et al.

(10) Patent No.: US 7,789,820 B2
(45) Date of Patent: Sep. 7, 2010

(54) APPARATUS AND METHOD FOR PROVIDING CONTINUOUS ACCESS TO AN ISOLATION SPACE WHILE MAINTAINING ISOLATION

(75) Inventors: Charles K. Akers, 170 S. Cayuga Rd., Williamsville, NY (US) 14221; Theodore A. M. Arts, Williamsville, NY (US)

(73) Assignee: Charles K. Akers, Willamsville, NY (US)

( * ) Notice: Subject to any disclaimer, the term of this patent is extended or adjusted under 35 U.S.C. 154(b) by 994 days.

(21) Appl. No.: 11/402,758

(22) Filed: Apr. 12, 2006

(65) Prior Publication Data

US 2006/0247487 A1 Nov. 2, 2006

Related U.S. Application Data

(60) Provisional application No. 60/670,587, filed on Apr. 12, 2005.

(51) Int. Cl.
*A61G 10/00* (2006.01)

(52) U.S. Cl. ..... 600/21

(58) Field of Classification Search ..... 600/21–22; 128/202.12; 55/385.2; 454/187–189; 119/300–328; 312/1

See application file for complete search history.

(56) References Cited

U.S. PATENT DOCUMENTS 3,498,687 A * 3/1970 Diccianni ..... 312/1
4,950,222 A * 8/1990 Scott et al. ..... 600/21
5,056,875 A 10/1991 Akins
5,205,624 A * 4/1993 Martell et al. ..... 312/1
5,259,812 A * 11/1993 Kleinsek ..... 454/57
5,316,733 A * 5/1994 Rune et al. ..... 422/104
5,360,001 A 11/1994 Brill et al.
5,860,711 A * 1/1999 Kronberg et al. ..... 312/1
5,975,081 A * 11/1999 Hood et al. ..... 128/845
6,461,290 B1 * 10/2002 Reichman et al. ..... 600/21
6,685,622 B2 * 2/2004 O'Connor et al. ..... 600/21
6,969,346 B2 * 11/2005 Perlatti ..... 600/21

FOREIGN PATENT DOCUMENTS

WO 99/06115 2/1999
WO WO2004/011041 2/2004

OTHER PUBLICATIONS

European Search Report, EP 06 74 9859.

* cited by examiner

*Primary Examiner*—Samuel G Gilbert
(74) *Attorney, Agent, or Firm*—Lerner, David, Littenberg, Krumholz & Mentlik, LLP

(57) ABSTRACT

An isolation container includes an isolation space for receiving an object and maintains the isolation space substantially isolated while providing for continuous access to, and maneuverability within, the isolation space through one or more access ports. An air management system re-circulates air through the isolation space to create a negative or positive pressure within the space, and is operable to filter, and optionally adjust the temperature and humidity of, the re-circulating air. In an embodiment of the isolation container configured for transporting a patient in the isolation space, a communications system is also coupled to the isolation space to provide for audio, video or other data communications between the patient and a communications device external to the isolation container.

7 Claims, 22 Drawing Sheets

10
30
32
A3
A3
A1
A1
240, 242
271
270
272
274
276
278
280
50
252
250
254
255A
255B
255C
255D
256
257A
257B
257C
257D
E

APPARATUS AND METHOD FOR PROVIDING CONTINUOUS ACCESS TO AN ISOLATION SPACE WHILE MAINTAINING ISOLATION

CROSS REFERENCE TO RELATED APPLICATIONS

This application claims the benefit of U.S. Provisional Application Ser. No. 60/670,587 filed Apr. 12, 2005, assigned to the assignee of this application and incorporated by reference herein. The subject matter of U.S. application Ser. No. 11/089,795 filed Mar. 25, 2005, U.S. application Ser. No. 10/434,041 filed May 8, 2003, and PCT publication WO 2004/011041 A2, published on Feb. 5, 2004, each of which is assigned to the assignee of the present invention and is incorporated by reference herein, are related to this application.

FIELD OF THE INVENTION

The present invention relates generally to isolation containers and, more particularly, providing continuous access to an isolation space while maintaining the isolation space substantially isolated from the external environment.

BACKGROUND OF THE INVENTION

In the healthcare field, industry and scientific research, it is often desirable or required to have a space that is partially or completely isolated from the external environment. For example, chemical and biological research experiments often need to be performed within an enclosed, isolated environment, such as in a fume hood, to prevent the release of noxious gases that can harm the scientist performing the experiment, or to prevent the introduction of contaminants from the external environment that can compromise the integrity of the experiment being performed.

In the healthcare field, the need to maintain a patient isolated from the external environment sometimes is extremely critical to the healthcare of the patient, and also to the health and safety of medical personnel treating, or others who may come near, the patient. For example, when a patient with an infectious disease is transported, such as from home to a hospital by ambulance, or alternatively by helicopter or aircraft, there is a risk that the patient, if not isolated, can infect and contaminate medical personnel treating and transporting the patient, spectators, the transport vehicle and the surroundings. Also, when the patient being transported has a suppressed immune system, such as a patient with AIDS, there is a risk that the patient, if not isolated, can become infected by biological agents from medical personnel treating and transporting the patient, spectators, the transport vehicle and the surroundings. In addition, patients with open wounds and burns who are not isolated during transport may be susceptible to infection, because they may be exposed to bacteria in the transport vehicle or carried by medical personnel.

Therefore, it is desirable to isolate an infectious and/or injured patient from the external environment during transport as part of the medical treatment being provided to the patient, and furthermore for protecting the health and safety of medical personnel caring for the patient during transport. Although prior art devices for transporting a patient isolated from the external environment exist, such devices usually limit the ability of medical personnel to continuously and completely access the patient. In these prior art, isolation-capable patient transport devices, the patient often is enclosed within a bulky, opaque vinyl bag, which would be placed on a conventional litter. Such isolation-capable patient transport devices either do not allow access to the patient, unless the bag is opened such that the patient is no longer in isolation, or include a single or several fixed access ports, known as glove ports, through which medical personnel can access only the portion of the isolated patient in proximity to the port. Consequently, medical personnel attending to the patient during transport cannot readily access various regions of the patient while the patient is maintained in the isolation condition, because the glove port is at a fixed location that does not necessarily provide access to the region(s) of the patient that may require medical treatment. Further, where the bag includes several fixed glove ports, the personnel must remove their hands from one glove port and then re-insert their hands in another glove port to access a different portion of the patient, which is an undesirable way of accessing various portions of the patient.

In addition, patient isolation bags adapted for use with litters usually are substantially opaque except for a small clear area, such that only a small portion of the patient within the bag is visible from the outside. Prior art patient isolation bags also are relatively thick, such that sound is substantially prevented from entering and leaving the bag. Therefore, visual and audio communication between a patient in an isolation bag being transported on the litter, and medical personnel external to the isolation bag and attending to the patient during transport, is difficult and sometimes impossible. The limited opportunity for, or absence of any, visual and audio communication between the patient in the isolation bag being transported on the litter and the personnel external to the isolated patient can adversely affect the medical treatment being provided to the patient during transport.

Therefore, there is a need for an isolation container defining an isolation space in which an object is maintained substantially isolated from the external environment and where the isolation space is continuously and readily accessible, such that various regions of the object contained within the isolation space is continuously and readily accessible. In particular, there is a need for an isolation container for containing an injured and/or infectious patient in an isolation space during transport which provides continuous access to the patient while the patient is maintained substantially isolated and also facilitates communication between the patient within the isolation space and individuals in the environment external to the isolation space.

SUMMARY OF THE INVENTION

In accordance with the present invention, an isolation container defines an isolation space for receiving an object, and maintains the object within the isolation space substantially isolated while permitting continuous access to the isolation space, and thus the isolated object, through at least one access port. The access port has predetermined length and width dimensions, and provides that a suitably sized insertion item, such as a hand, an arm, a tool or device, can be inserted into the isolation space through the access port. Upon insertion through the access port, the insertion item can be maneuvered in six degrees of freedom within the isolation space by corresponding movement of the insertion item into and out of, and along the lengthwise and widthwise dimension of, the access port. The access port, thus, permits movement of the insertion item to various regions within the isolation space and, thus, near or at various portions of the object contained within the isolation space, without removal of the insertion item from the access port. The isolation container further includes an air management system that maintains the isolation space substantially isolated by re-circulating air through the isolation space to create a desired negative pressure or a positive pressure in the isolation space. The air management system regulates the pressure in the isolation space by suitably adjusting air flow into and out of the isolation space and also intake of air from, and exhaustion of air to, the external environment. The air management system detects, or is supplied information representative of, changes to pressure within the isolation space, such as may result from insertion of an insertion item into an access port, manipulation of the insertion item while in the access port and removal of the insertion item through the access port, and accordingly regulates the air recirculation to maintain the desired pressure. The air management system also is operable to filter the re-circulating air, such that decontaminants are removed from the portion of the re-circulating air supplied to the isolation space or otherwise exhausted, such as to the external environment. In a further preferred embodiment, the air management system detects, or is supplied information representative of, temperature and moisture level in the isolation space, and accordingly heats, cools and adjusts the moisture level of the air being re-circulated to the isolation space to maintain desired temperature and humidity within the isolation space.

In a preferred embodiment, an isolation container is adapted for transporting a patient in an isolation space maintained substantially isolated while continuous access to the isolation space, and thus the isolated patient, is provided through at least one medical access port. The patient isolation container includes a wrap that by itself, or in combination with a litter or another structure, defines an isolation space in which the patent is received and maintained substantially isolated from the external environment. The wrap includes the at least one medical access port through which an insertion item, such as the gloved hands and arms of medical personnel, can be inserted and continuously access the patient within the isolated space. The access port further provides that the insertion item is maneuverable in six degrees freedom within the isolation space by movement of the insertion item into and out of, and along the lengthwise and widthwise dimensions of, the access port, without requiring the removal of the insertion item from the access port. The isolation container further includes, or is coupled to, an air management system having air supply and return lines extending to the isolation space through the wrap or other components that define the isolation space. The air management system monitors differential pressure within the isolated space, and regulates air recirculation for the isolation space by controlling air flow on the supply and return lines and intake and exhaust of external air, preferably using a valve mechanism, to maintain a desired negative pressure or positive pressure within the isolation space. In addition, the air management system includes an air decontamination device that filters the re-circulating air to control the contaminants in, and thus the quality of, the air supplied to the isolation space from, or exhausted to the external environment by, the air management system.

In a further preferred embodiment, the air management system includes a climate control module that monitors the temperature and humidity in the isolation space, based on detection of air within or withdrawn from the isolation space, or temperature and humidity information otherwise supplied to the management system, and suitably heats, cools, humidifies and dehumidifies the air re-circulated to the isolation space to maintain a desired temperature and humidity within the isolation space.

In a further preferred embodiment, the patient isolation container includes, or is coupled to, a communication system that provides for communication of audio, video and other electronic data between the patient and a communications device external to the isolation space. In one embodiment, the communication system includes an audio speaker, a microphone, a video camera and a push button call switch, each of which is located in the isolation space and electronically coupled to a controller preferably located external to the isolation space. The controller includes a communications component for communicating via hardwire connection, or wirelessly, with an external communication device. The communication system preferably further includes, for example, audio and video jacks and a data interface port, each of which is located on an external surface of an electromechanical compartment containing the controller and coupled to the litter or defining the isolation space, for connection to suitable components, such as a head set, a monitor and a portable electronic medical instrument system. In another embodiment, the communication system includes a speaker and a microphone located on an external surface of the compartment, which in combination with the speaker and microphone located in the isolation space provides for a local communication link between the patient and an individual within the immediate vicinity of the isolation space.

BRIEF DESCRIPTION OF THE DRAWINGS

Other objects and advantages of the present invention will be apparent from the following detailed description of the presently preferred embodiments, which description should be considered in conjunction with the accompanying drawings in which like references indicate similar elements and in which.

DETAILED DESCRIPTION OF THE INVENTION

For purposes of highlighting the features of the present invention, an isolation container for providing ease of continuous access to, and maneuverability within, an isolation space defined within the container while maintaining the isolation space substantially isolated from the external environment is described in detail below in connection with an isolation container adapted for transporting a patient in substantial isolation and providing continuous access to, and maneuverability within, an isolation space in which the patient is received while maintaining the patient substantially isolated. It is to be understood that the inventive of features of providing continuous access to, and maneuverability within, an isolation space while maintaining the isolation space substantially isolated from the external environment are readily applicable to other fields and industries, for example, manufacturing and also chemical and biological research, such as applied to fume hoods and like isolation chambers where substantial isolation of an object, which may or may not require transport, from the external environment is required and continuous access to all or substantially all of an isolation space in which an object is received and maintained substantially isolated, so as to allow continuous access to the object itself, is highly desirable.

In the healthcare field, personnel involved with the medical care and transport of a patient, such as a human or animal who needs to be substantially isolated from the external environment, desire to have continuous and complete access to the patient, such as for manipulating, administering medication to or adjusting medical devices attached to the patient, while the patient is maintained substantially isolated. In accordance with one embodiment of the present invention, an isolation container adapted for use as, or in connection with, a litter substantially isolates the patient from the external environment during transport, while simultaneously providing continuous access to various regions of the isolated patient.

Figure 1:
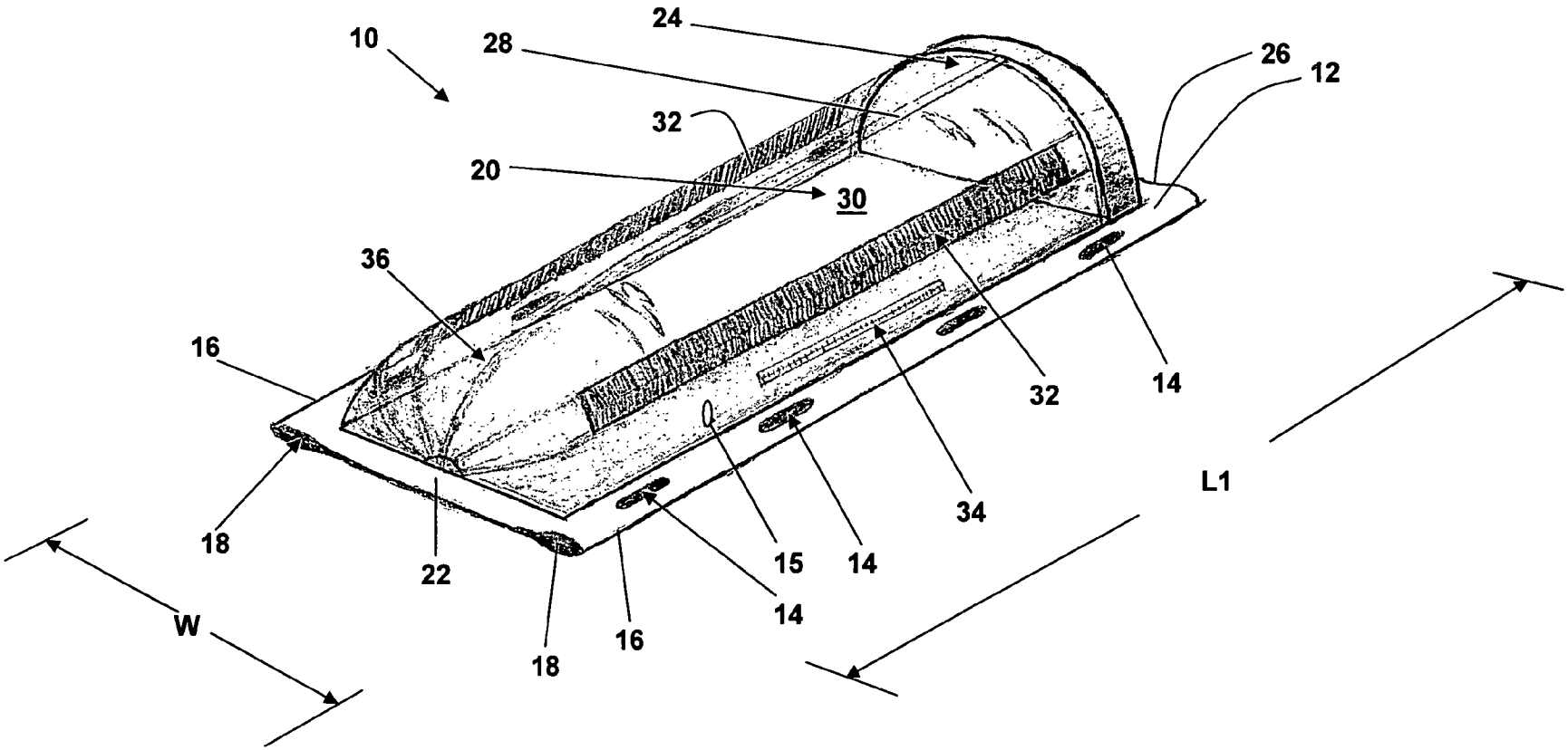
FIG. 1 is a perspective view of an embodiment of a patient isolation container in accordance with the present invention.

FIG. 1 is a perspective view of an illustrative embodiment of a patient isolation container 10, in accordance with the present invention, for transporting a patient in a substantially isolated condition. Referring to FIG. 1, the isolation container 10 includes a litter 12 containing a plurality of hand holds 14. The hand holds 14 are located adjacent to, and spaced along opposing longitudinal edges 16 of the litter 12, and are sized and spaced along the longitudinal length of the container 10 to provide that several individuals simultaneously can grasp the hand holds 14 for transporting the container 10. In a preferred embodiment, the litter 12 includes eight hand holds 14, four sets on each side, such that four or six people can carry the container 10.

The litter 12 optionally includes sleeve or pole slots 18 extending along the opposing longitudinal edges 16 of the litter 12. Poles (not shown) may be inserted into and through the pole slots 18 so that the container 10 can be lifted by transporters who grasp pole ends at foot end 22 and head end 26 of the litter 12.

Still referring to FIG. 1, the isolation container 10 includes an impermeable material layer or wrap 20 that is connected to the litter 12 along opposing longitudinal lengths extending between the opposing hand holds 14 and at the foot end 22 of the litter 12, and also connected to an electromechanical compartment 24 at the head end 26 of the litter 12. The wrap 20 is connected to the litter 12 and the compartment 24 by a permanent or separable connection. Permanent connections include sonic welding, sewing and gluing, for example. Separable connections include Velcro®, a zipper, Ziplok® and double-sided tape, for example. If a separable connection is used, the litter 12 may be reused after cleaning and connection of a new wrap 20.

When the isolation container 10 is used to transport a patient substantially isolated from the external environment, the patient is positioned on the litter 12 and the wrap 20 is secured to the litter 12 and the compartment 24 to define an isolation space 30 in which the patient is enclosed. An air management system 50, which is included in the compartment 24, or alternatively on the litter 12 or remotely, is coupled to the isolation space 30 and operates to maintain the space 30 substantially isolated from the external environment. The air management system 50 is described in detail below in the text accompanying the description of FIGS. 2, 18A, 18B, 19A and 19C.

In a preferred embodiment, each of the litter 12 and the wrap 20 comprises a clear or substantially clear, high strength, flexible, non-puncture, impermeable material, such as a laminated vinyl fabric, and optionally includes a non-reflective coating. The wrap 20, and optionally the litter 12, preferably is a transparent polymeric material, so that individuals may observe a patient within the isolation space 30 and the patient also may see outside of the wrap 20 or the litter 12. As the litter 12 is a flexible fabric, it will wrap around the patient when the container 10 lifted. It is noted that such a patient container 10 meets the NATO requirements for patient transport.

In an alternative preferred embodiment, the wrap 20 is a separate component, such as a sealable bag, that defines the isolation space 30 in which a patient is enclosed and maintained substantially isolated from the external environment. The separate component wrap 20 optionally includes hand holds on longitudinal edges that are similar in positioning and construction as the hand holds 14 on the edges 16 of the litter 12. In a further embodiment, at least one of the separate component wrap 20 and the litter 12 includes separable or permanent connections, as described above, for connecting the wrap 20 to the litter 12. In such embodiment, as the litter 12 does not define the isolation space 30, the litter 12 may comprise a heavy duty tarp like material, as used for tents, for example, that can support the isolation container 10 including a patient. Alternatively, the litter 12 may be a hard, stiff support, such as plastic, wood or metal.

In accordance with the present invention, an isolation container, such as the exemplary isolation container 10, includes at least one access port for providing continuous access to, and maneuverability in six degrees of freedom within, the isolation space 30. The air management system 50, as discussed in detail below, maintains the isolation space 30 substantially isolated from the external environment when an insertion item, such as gloved hands and arms or another object, is (i) inserted through the access port and into the isolation space; (ii) moved into and out of and/or along a lengthwise or widthwise dimension of the access port, in other words, maneuvered in any of six degrees of freedom within the isolation space; and (iii) removed from the access port.

Referring again to FIG. 1, the wrap 20 includes longitudinally extending medical personnel access ports 32 positioned to provide access to respective sides and the top of a patient. The wrap 20 also can include transversely extending access ports instead of, or in addition to, the longitudinally extending ports. The access ports 32 are flexible interfaces between the external environment and the isolation space 30, and provide that a person can insert his hands and arms through the port 32 and move from one end of the space 30 to the other end, while the air maintenance system 50 maintains the isolation space 30 substantially isolated from the external environment. Thus, with the container 10 of the present invention a person does not need to remove his hands and arms from the space 30 and then re-insert them at a different access port to obtain access to a different region of the isolation space 30, and thus the patient contained within the space 30, as is required in some prior art devices for transporting patients in an isolated condition.

In a further embodiment, the wrap 20 includes an auxiliary access port 34 through which food, water and other such items can be inserted into the isolation space 30. Like the access port 32, the access port 34 is a flexible interface that allows the insertion of hands and arms into the isolation space 30 along with tubes and wiring, such as associated with IV tubing, medical monitors, a power cord and a ventilator. The access port 34 may be sealed, for example, by a zipper mechanism. A flap may be provided over the zipper to protect the zipper mechanism. Alternatively, the access port 34 may be closed by a Ziplok® mechanism, which may provide an airtight seal, or Velcro®, as described below. As discussed in detail below, the air management system 50 controls the air pressure within the isolation space 30 so that a small airflow through the ports 32 or 34, which can occur when an item is or is not inserted through port into the isolation space 30, may be tolerated without affecting the substantially isolated condition of the patient within the isolation space 30. In other words, the air management system 50 maintains the patient substantially isolated from the external environment while permitting continuous and moveable access to various regions of the patient via the access ports 32, 34.

Referring again to FIG. 1, the wrap 20 may include a large enclosure port 36, such as a slit, extending across the longitudinal length of the wrap 20 and through which a patient may be inserted into and removed from the wrap 20, in other words, into and out of the isolation space 30. A zipper mechanism may be provided along the port 36 to open and close the wrap 20. As described above for the access port 34, a flap may be provided with the port 36, but is not required. The port 36 may also be closed by a Ziplok® mechanism, which provides an airtight seal, or Velcro®.

In a preferred embodiment, the port 36 extends along the entire longitudinal length of the isolation space 30 to provide complete access to the space 30, and is of sufficient length, such that, when completely opened, a patient can be placed on the litter 12 and then the wrap 20 can be closed and sealed at the port 36 to define the isolation space 30.

Alternatively, an entry/exit slit may be provided along three of the edges of the wrap 20. For example, the entry/exit slit may be provided extending along the edge 26, the edge 22 and one of the longitudinal edges 16. This configuration is referred to as "C-shaped" enclosure port.

Still referring to FIG. 1, the compartment 24 is provided adjacent the edge 26, or alternatively adjacent the edge 22, and may contain control, communication, electrical and mechanical devices. In a preferred embodiment, the compartment 24 includes a controller 52, the air management system 50, a power supply 54 and a communications system 56 (not shown in FIG. 1).

Figure 2:
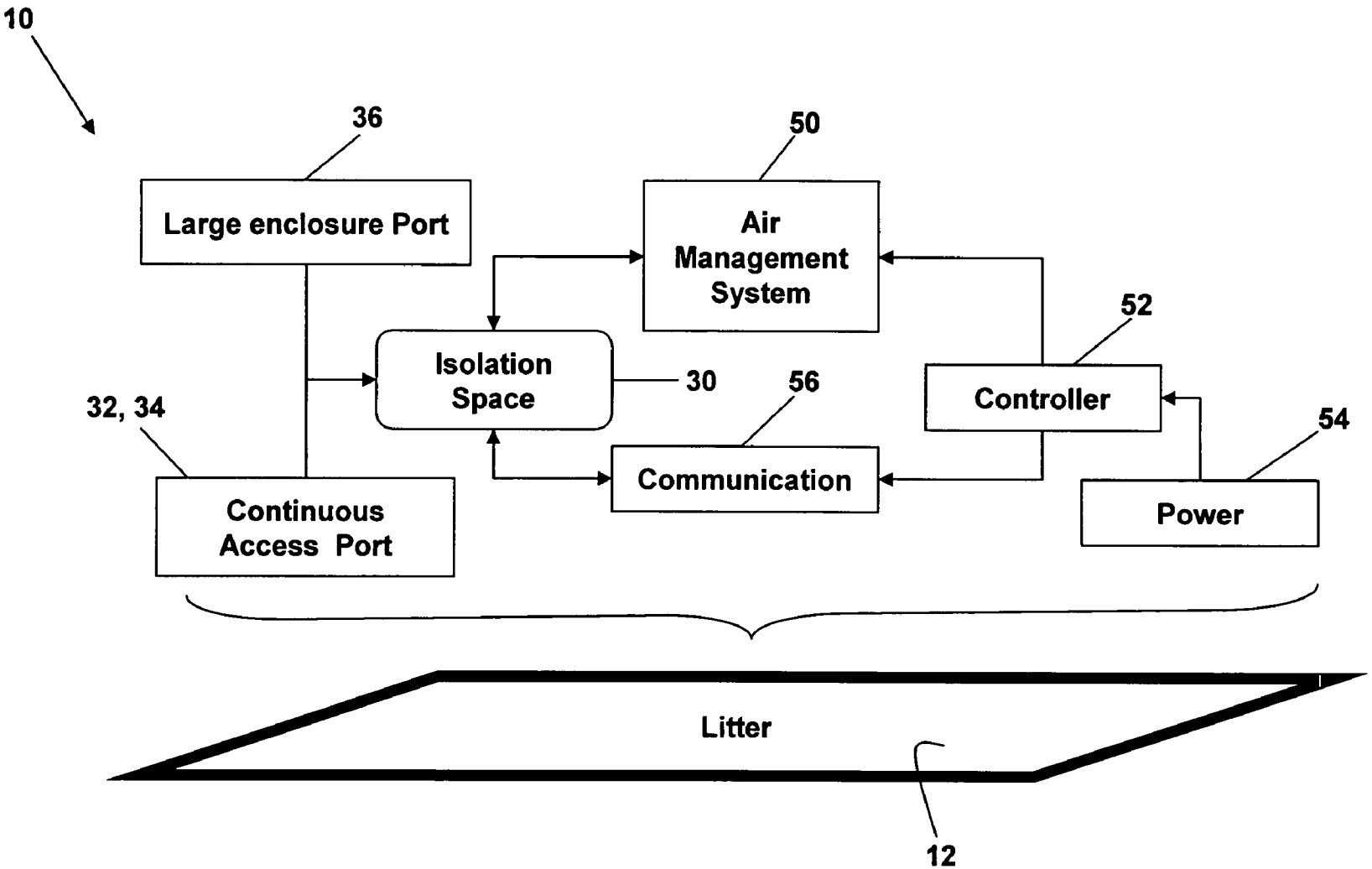
FIG. 2 is a functional block diagram of an exemplary patient isolation container in accordance with the present invention.

FIG. 2 illustrates a preferred embodiment of the patient isolation container 10 in accordance with the present invention. Referring to FIG. 2, the controller 52 is coupled to each of the air management system 50, the power supply 54 and the communications system 56. Further, each of the systems 50 and 56 are coupled to the isolation space 30, and the isolation space is mechanically coupled to the ports 32, 34 and the enclosure port 36. The controller 52 supplies electrical power provided by the power supply 54 to the air management system 50 and the communication system 56. The air management system 50 alone, or in combination with the controller 52, maintains the pressure within the isolation space 30 at desired levels, filters the portion of the re-circulating air supplied to the isolation space 30 or otherwise exhausted, and optionally maintains climatic conditions in the isolation space 30 at desired levels. In addition, the communication system 56 alone, or in combination with the controller 52, provides for communication of data, which may include audio, video or alerting data, between the isolation space 30 and the external environment. The communications capabilities of the communication system 56, which may include wired or wireless communication signal transmission and reception capabilities, are described in further detail below in the text accompanying the description of FIG. 20.

The power supply 54 is an AC or DC electrical power source having corresponding interfaces, and optionally includes conventionally known low power level detection and visual or audible alarm means. In a preferred embodiment, the power supply 54 is a battery, which is optionally rechargeable, and includes the capability of receiving a power cord and using electrical energy conveyed over the power cord from, for example, a power source included in a vehicle or aircraft or a standard 120V/220V AC power line.

It is to be understood that each of the systems 50 and 56, the controller 52 and the power supply 54, which are described as performing data processing operations, includes a software module or, alternatively, a hardware module or a combined hardware/software module. In addition, each of the systems 50 and 56, the power supply 54 and the controller 52 suitably contains a memory storage area, such as RAM, for storage of data and instructions for performing processing operations in accordance with the present invention. Alternatively, instructions for performing processing operations can be stored in hardware in the systems 50 and 56, the power supply 54 and the controller 52.

In a preferred embodiment, the isolation container 10 has a length L1 of 7.5 feet, a width W of 30 inches and a height H (see FIG. 17B) of 20-24 inches. The isolation space 30 may have a length of 4-6 inches. It is to be understood that an isolation container, in accordance with the present invention, may have other dimensions, as desired for the particular application, such as an isolated fume hood.

Referring to FIGS. 1 and 2, in use of the isolation container 10 under normal conditions, the access ports 32 and 34 are in a closed position that seals the isolation space 30 from the external environment, such that the pressure gradients within the isolation space 30 are maintained substantially constant. The system 50, as described below, monitors the pressure in the isolation space 30 and by controllably recycling air into the isolation space, suitably adding air obtained from the environment to the isolation space or exhausting air withdrawn from the isolation space to the environment, maintains negative pressure or positive pressure in the isolation space 30.

In an alternative embodiment of the isolation container 10, referring to FIG. 1, the wrap 20 optionally includes one or more separate vents 15. The vents 15 can be used instead of, or in combination with, the access ports 32 and other openings, such as the port 34, for controlled leakage into or out of the isolation space 30. In a preferred embodiment, the vents 15 are controllable, either manually, electronically or both manually and electronically, to allow for metering the leakage of air into or out of the isolation space 30 so that negative or positive pressure is created in the isolation space 30. In such operation, the medical access ports 32 and other openings may be sealable during use.

Figure 3A:
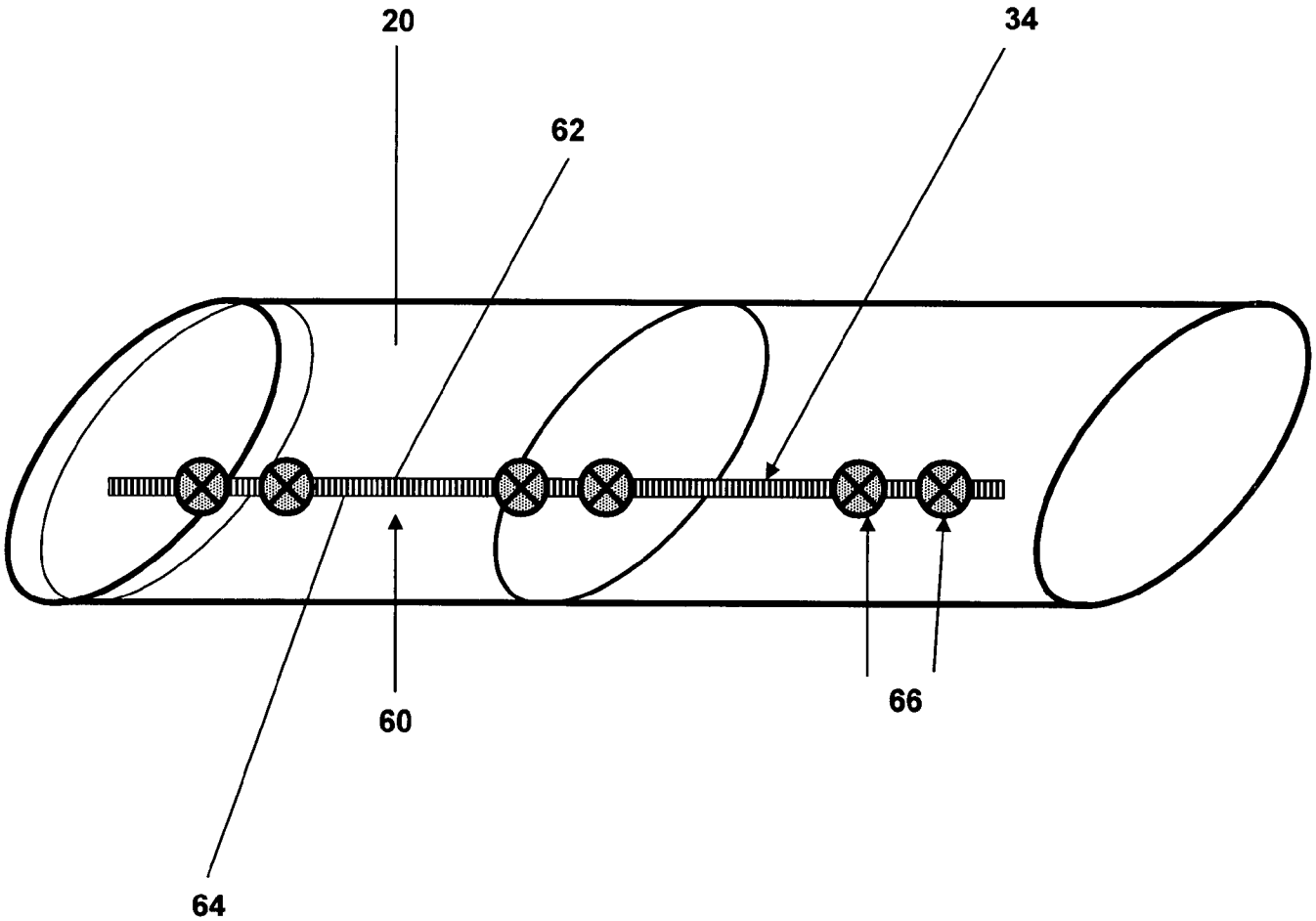
FIG. 3A is a schematic representation of an embodiment of an access port for an isolation container in accordance with the invention.

FIG. 3A illustrates an exemplary medical access port 32 for an isolation container in accordance with the present invention, such as the isolation container 10. Referring to FIG. 3A, the port 32 is a longitudinal slit through the wrap 20 and an easily re-sealable connection mechanism 60 along the slit. A pair of tracks or strips 62, 64 is provided along the edges of the slit including the connection mechanism 60. Hand ports 66 are provided along the tracks 62, 64. The connection mechanism 60 may be a zipper, a Ziplok® zipper locking mechanism or Velcro®, for example. The zipper may be of conventional design, such as those used in pants and coats, for example. The zipper teeth are supported along each of the tracks 62, 64. The zipper locking mechanism is similar to those used to reseal plastic bags. The track 62 comprises a protruding member extending along its length and the track 64 includes a recess along its length to receive the protruding member in a press-fit. The protruding member may be readily removed from the recess to open all or a portion of the longitudinal slit 60. The protruding member may also be readily pushed into the recess to close the medical access port 32.

Velcro® strips may also be provided along the edges of the slit to form the connection mechanism 60. As is known in the art, a Velcro® connection comprises one strip with small plastic hooks and an opposing strip with small plastic loops. When brought in contact, the hooks on one strip engage the loops on the opposing strip. Velcro® strips may be readily connected and separated.

One or more insertion ports 66, such as glove or hand ports 66, are movably coupled to the connection mechanism 60, as shown in FIG. 3A. In this example, movement of the port 66 along the longitudinal length of the medical access port 32 by the hand of a doctor, for example, opens the connection mechanism 60 in front of the port 66 and closes the connection mechanism 60 behind the port 66, as the port 66 is moved. In this way, the port 66 may be moved to a position proximate to a portion of the patient where manual access is needed.

Figure 3B:
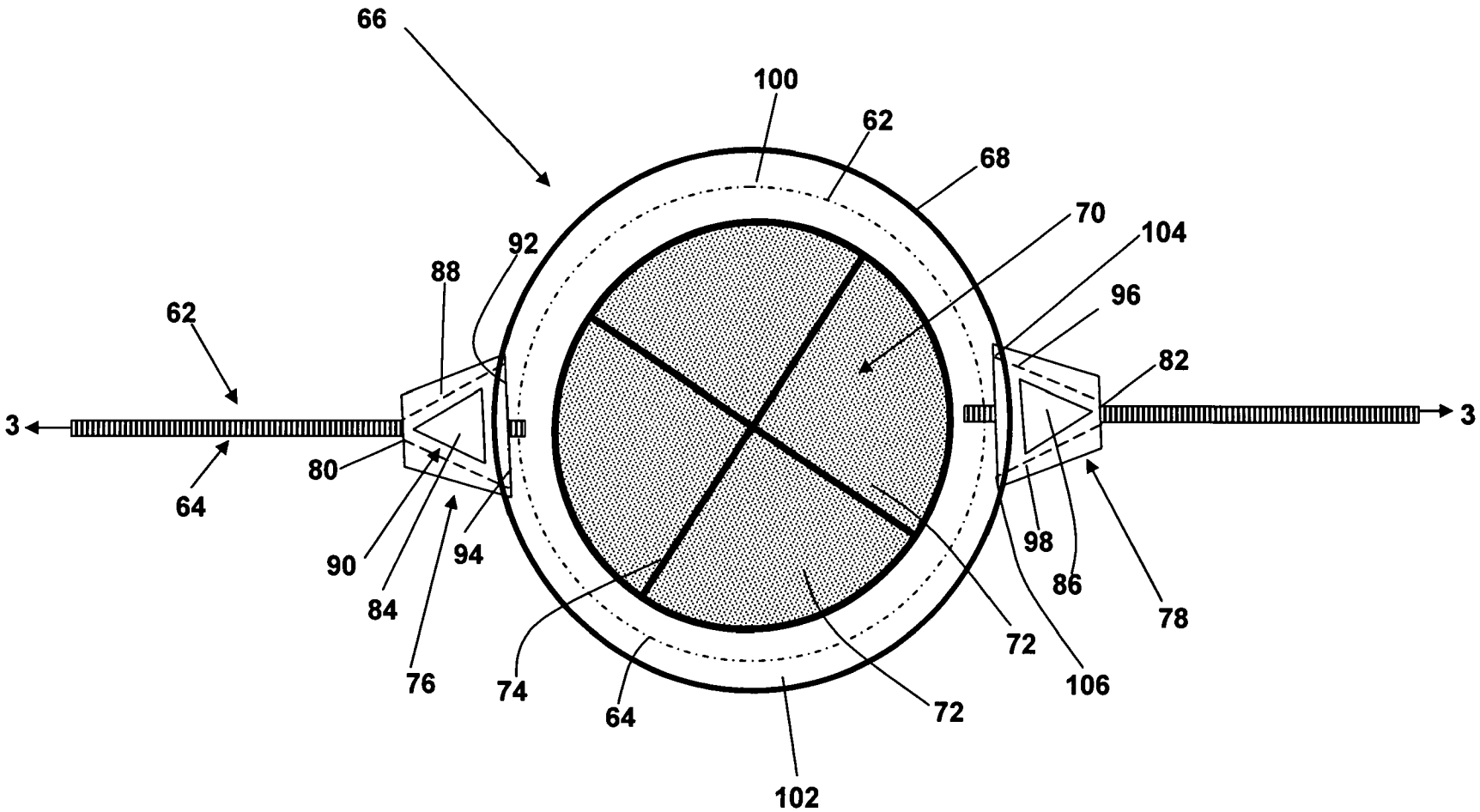
FIG. 3B is an enlarged view of a moveable glove port included in the access port of FIG. 3A.

FIG. 3B shows an enlarged view of the movable port 66, which comprises a frame 68 supporting the port 66. The port 66 also preferably comprises an iris valve 70 comprising multiple layers of polymeric material 72, as is known in the art. One or more slots 74 are cut, or otherwise provided, through the layers 72 to allow for the entry of a person's hand. Medical personnel typically put on a glove prior to insertion of a hand through the port 66. The layers 72 are moved aside by the entry of the user's hand as the hand is moved through the port 66. The layers 72 maintain contact with the hand or arm of the user, providing a partial barrier to air flow through the port 66. It is noted that some airflow through the access port 32 is desirable for venting air, as discussed further below. A glove (not shown) may be coupled to the frame 68, extending into the isolation space 30. If the glove is provided, an iris valve is not needed. A glove may be coupled to any of the glove or hand ports discussed below, as well.

If the connection mechanism 60 is a zipper, a Ziplok® mechanism or Velcro®, first and second tabs 76, 78 are coupled to the frame 68 along an axis 3-3 through the frame 68. If the frame 68 is round, the tabs 76, 78 may be coupled to the frame 68 along a diameter of the frame 68, for example. The tabs 76, 78 comprise external openings 80, 82, respectively, that receive the tracks 62, 64. Behind the external openings 80, 82 are wedges 84, 86, respectively. The wedge 84 defines passages 88 and 90 to internal openings 92, 94, respectively, that provide communication with upper and lower channels 100, 102 within the frame 68. Similarly, the wedge 86 defines passages 96 and 98 to internal openings 104, 106, respectively, that provide communication with the upper and lower channels 100, 102 within the frame 68. When the hand port 66 is moved to the right in FIG. 3B, for example, the wedge 86 separates the tracks 62, 64. The track 62 moves through the upper channel 100 and the second 64 track moves through the lower channel 102. The tracks 62, 64 converge as they exit the frame 68 and are brought into contact and then connection within the tab 76, as the tracks 62, 64 leave the tab 76. If the hand port 66 is moved to the left, the process is reversed. The tabs 76, 78 are suitably configured to open and close a zipper, a zip lok, or Velcro® with movement of the hand port 66.

Figure 4:
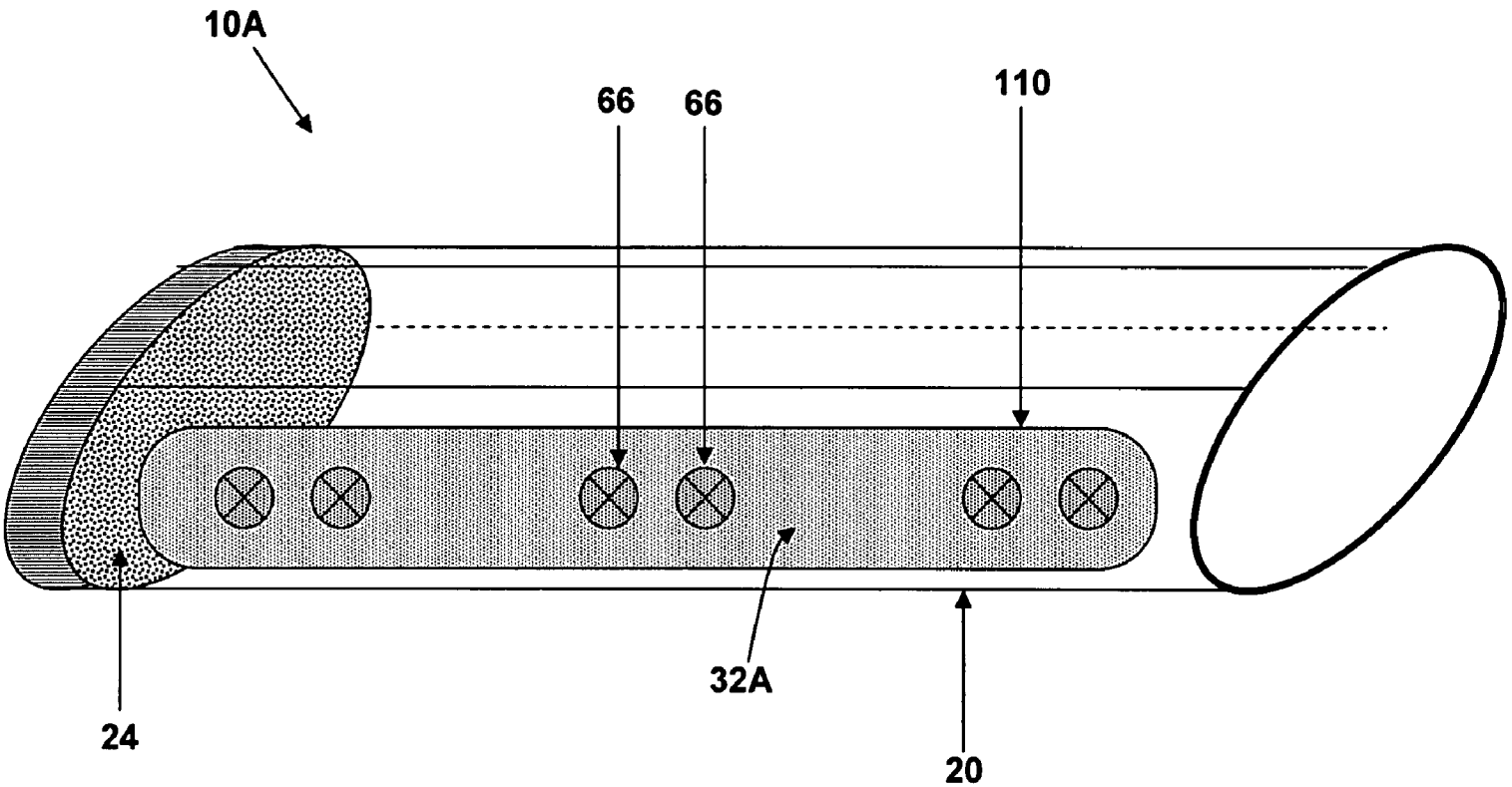
FIG. 4 is a schematic representation of another embodiment of an access port including a flexible membrane for an isolation container in accordance with the present invention.
Figure 5:
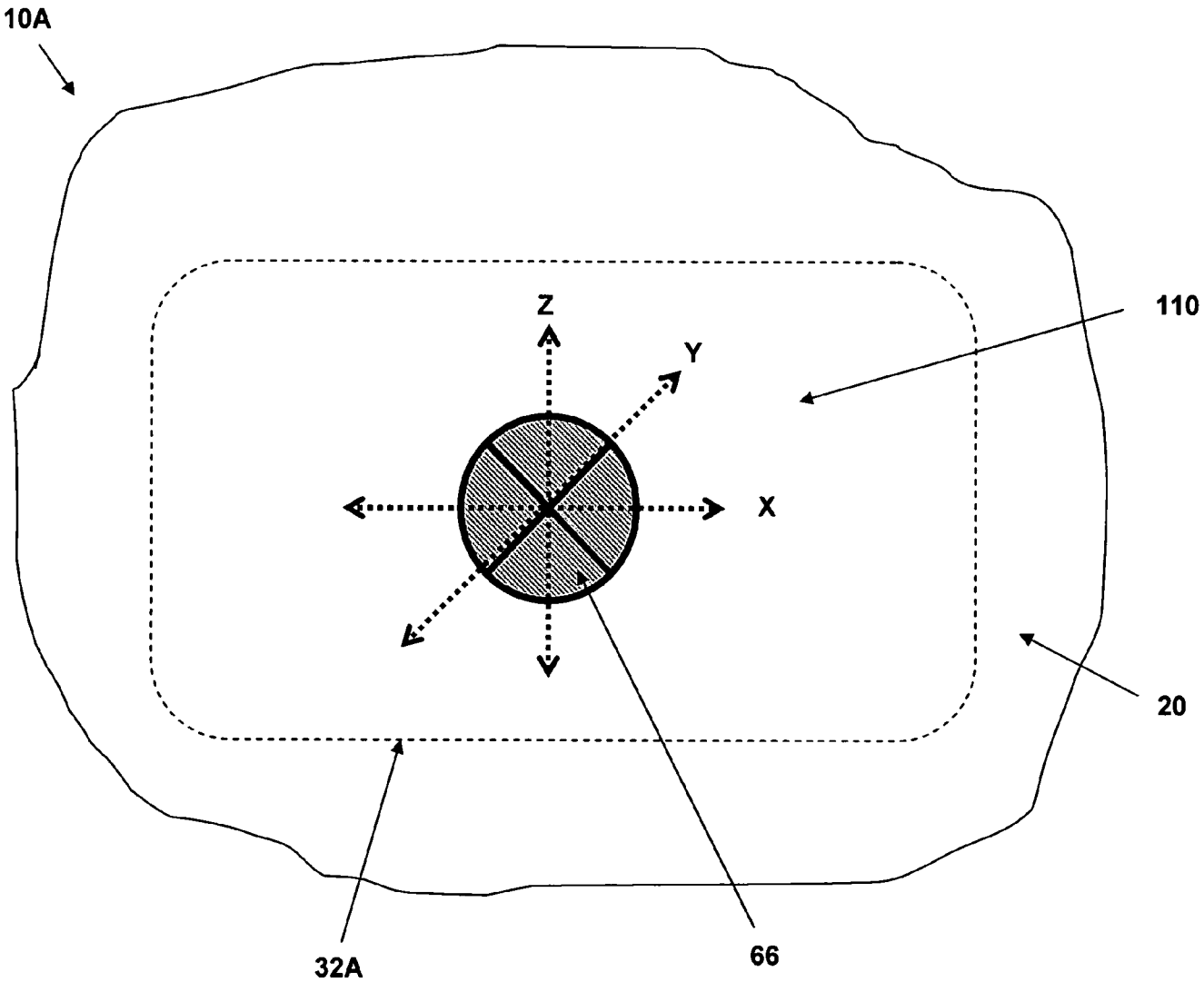
FIG. 5 is an enlarged view of a movable hand port included in the access port of FIG. 4.
Figure 6:
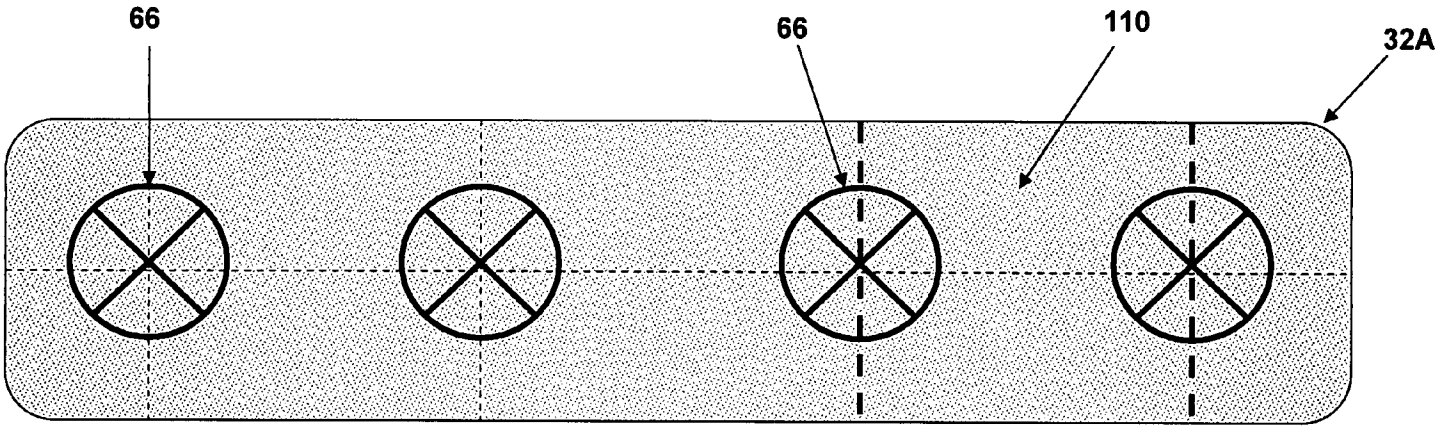
FIG. 6 is a partial view of the access port of FIG. 4 with the movable hand ports in a first position.
Figure 7:
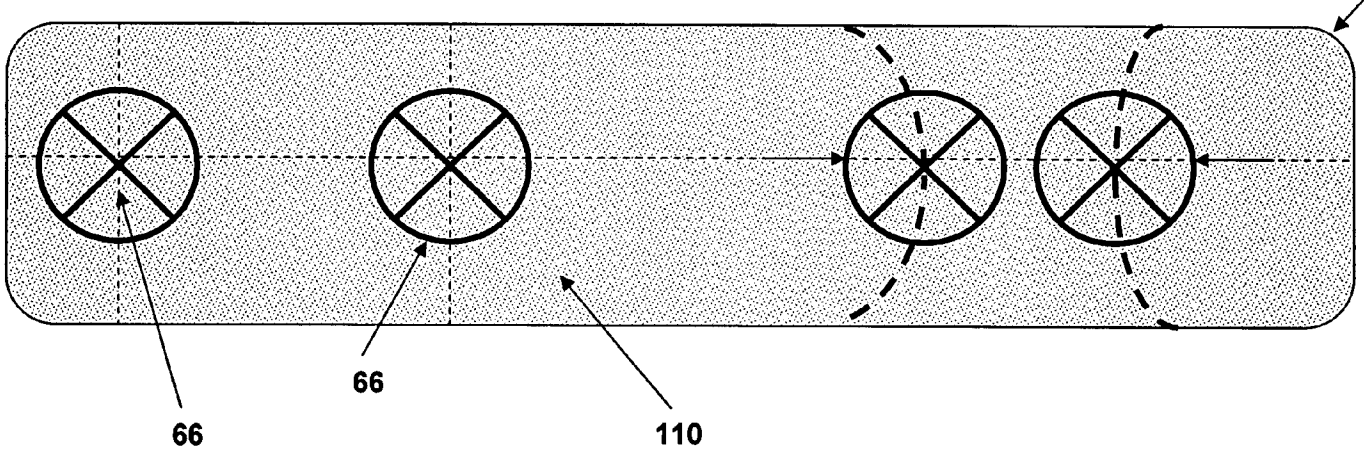
FIG. 7 is a reproduction of FIG. 6 with the movable hand ports in a second position.

FIG. 4 illustrates an embodiment of an isolation container 10A including an access port 32A in accordance with the present invention. Referring to FIG. 4, the port 32A includes an elastic polymer membrane 110 that is attached about its perimeter to the wrap 20. The membrane 110 supports several individually movable hand ports 66. The hand ports 66 may be moved in any direction along the access port 32A by a hand or arm inserted through the port 66. Referring to FIG. 5, which shows an enlarged front view of one of the ports 66 of the access port 32A of the container 10A, the flexible membrane 110 stretches as the port 66 is moved. The port 66 may be moved and rotated along six degrees of freedom along the x, y and z axes. FIG. 6 shows four hand ports 66 supported by the membrane 110 of the container 10A in a normal, relaxed position. FIG. 7 shows two of the four hand ports 66 of the container 10A moved towards each other, as they might be moved by a pair of hands of a doctor examining or treating a patient within the isolation space 30 of the container 10A.

The membrane 110 may be neoprene rubber or silicone, for example. In one example, the gloves may be moved up to about 12 inches by stretching the membrane 110. Movements in the range of about 4-6 inches would be typical. Enough glove ports 66 are preferably provided to enable full access to the patient in the isolation space 30, without excessive stretching of the membrane 110.

Figure 8:
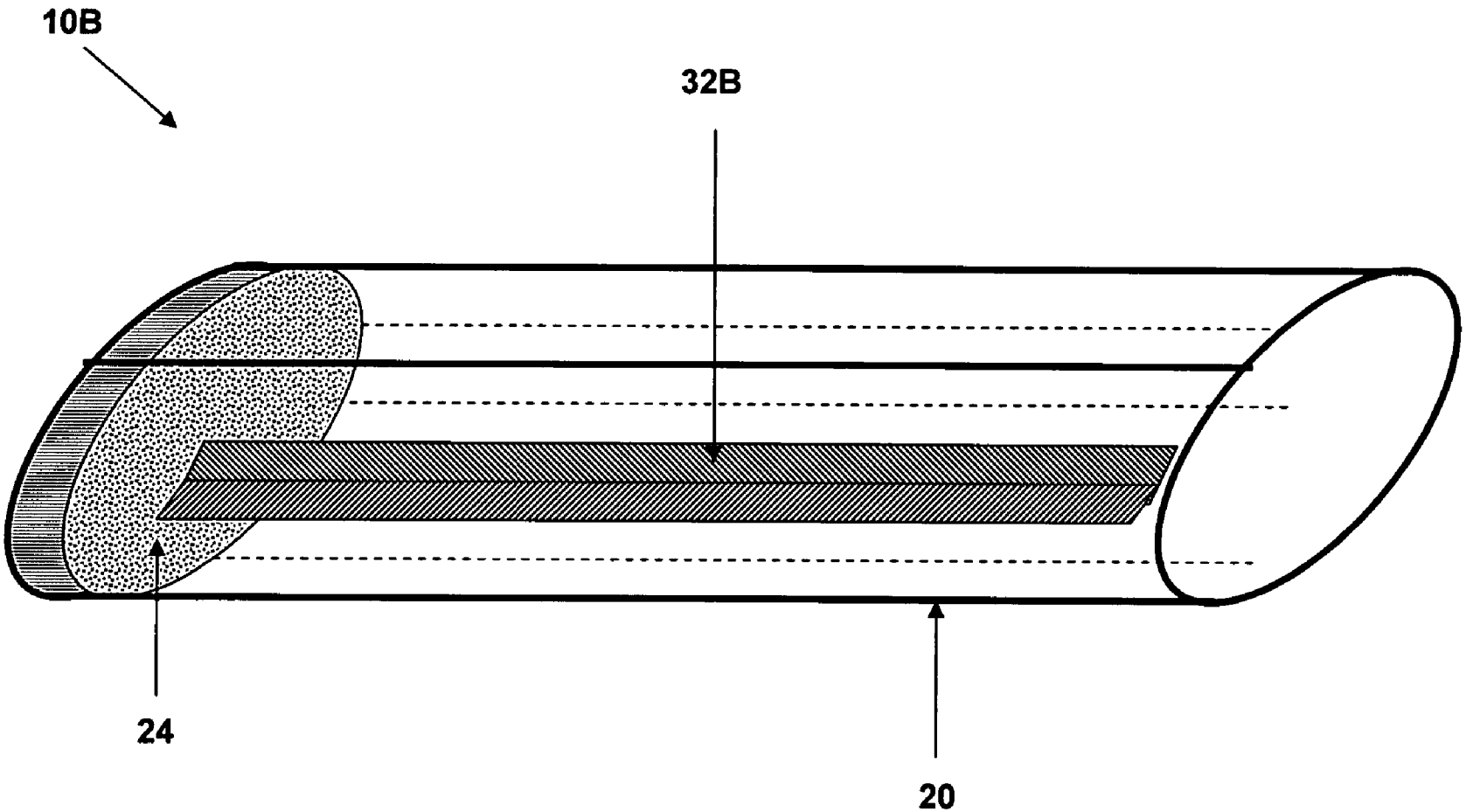
FIG. 8 is a schematic representation of still another embodiment of an access port including finger extensions for an isolation container in accordance with the present invention.

FIG. 8 illustrates another embodiment of an isolation container 10B including an access port 32B that is a continuous obstructed medical access port. As used herein "obstruct" means to control the movement of, but not completely block, air leakage through the port. As mentioned above, some leakage is desired for venting air into or out of the isolation space 30. Ports of this configuration may extend longitudinally or transversely. The port 32B may be formed by cutting a section of the wrap 20 of a desired size and shape. For example, the section may be a rectangle having a length almost as long as the longitudinal length of the wrap 20. In one example the wrap may be about 7.5 feet in longitudinal length and the port 32B may have a length of about 7 feet and a width of about 6-8 inches.

Figure 9:
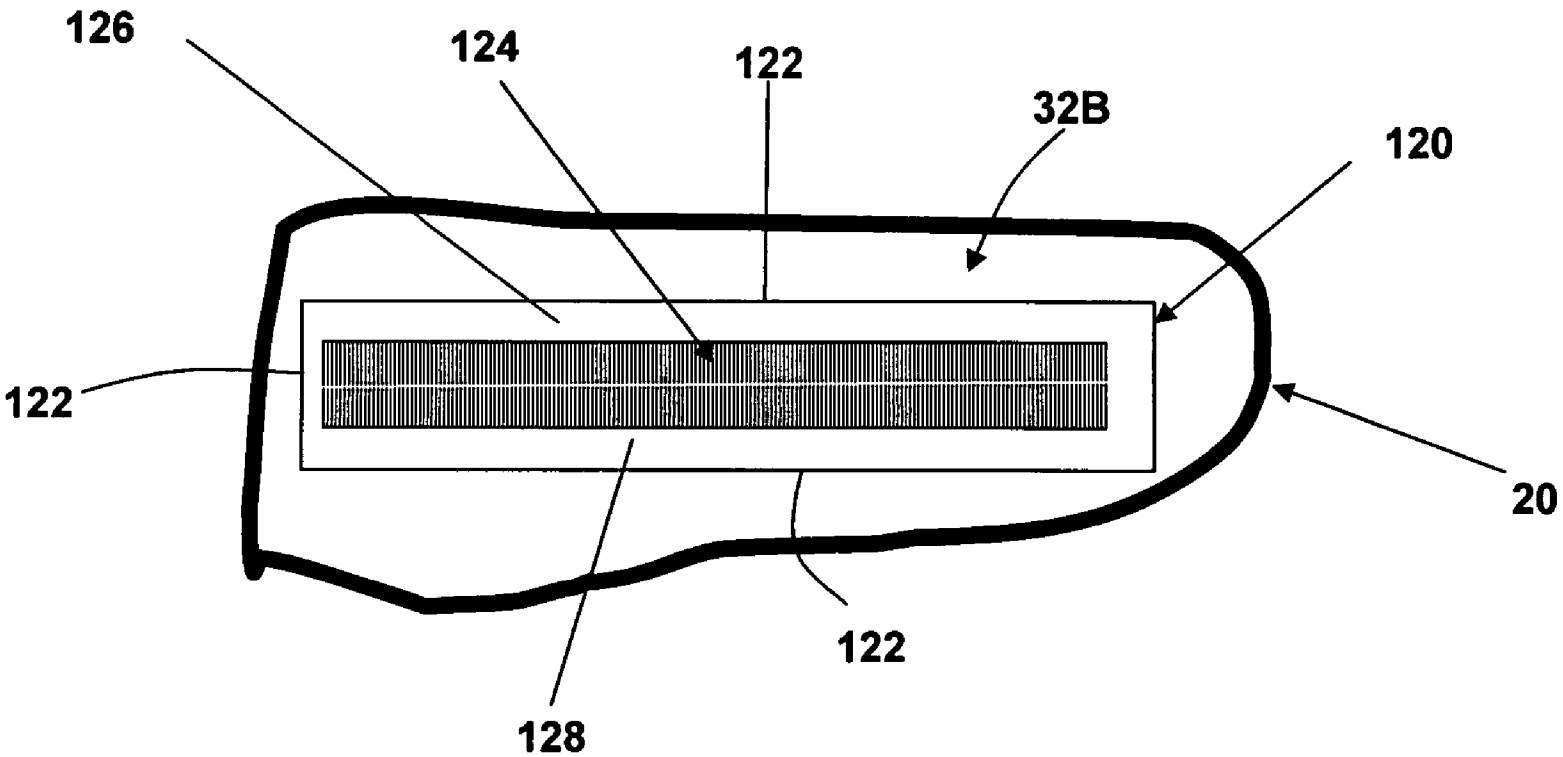
FIG. 9 is an enlarged, front view of the access port of FIG. 8.

Referring to FIG. 9, which is enlarged front view of the access port 32B shown in FIG. 8, a frame 120 is attached to boundary 122 of the open section of the wrap 20 in which the port 32B is disposed. The frame 120 may be a heavy polymer or rubber, and may be coupled to the wrap 20 by adhesive, Velcro®, ultrasonic welding, sewing, etc. In the access port 32B or like port configurations, hand or glove ports are not provided. Where the isolation container 10 includes a medical access port identically or similarly configured as the port 32B, and it is desired to access the patient within the isolation space, medical personnel would typically put on gloves and then insert their hands through the port 32B. The frame 120 may comprise neoprene, polyvinyl chloride ("PVC") or polymethylacrylate ("PMA"), for example.

Figure 10B:
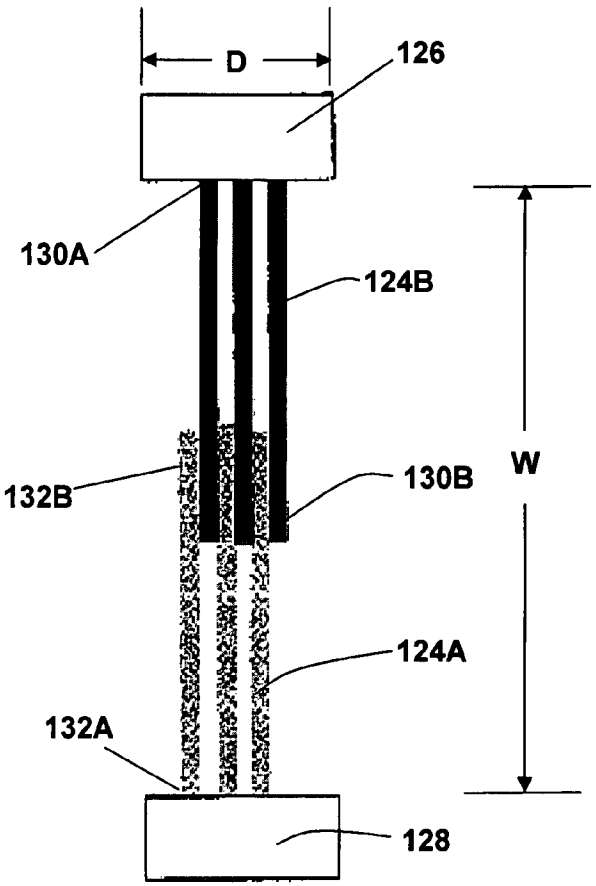
FIG. 10B is a cross-sectional view of the port of FIG. 8 as taken along line 10B-10B in FIG. 10A.
Figure 10A:
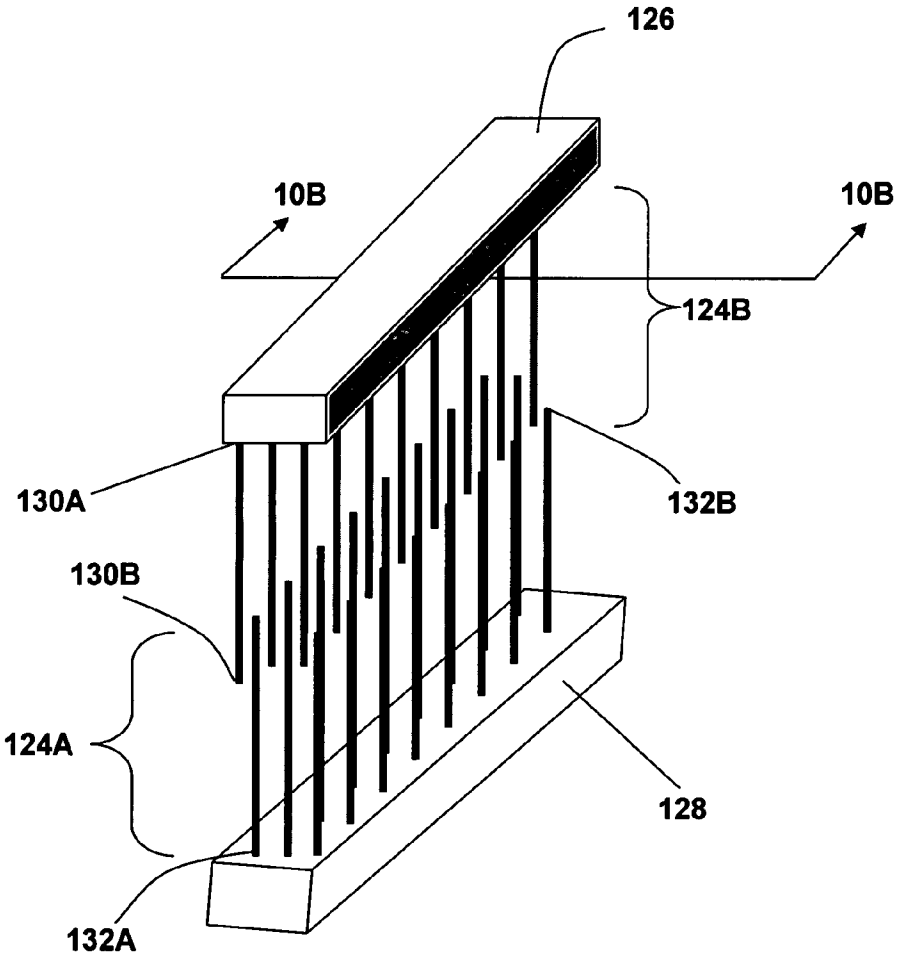
FIG. 10A is an enlarged, perspective view of a portion of the access port of FIG. 8.

Referring again to FIG. 9, the access port 32B is obstructed by a plurality of lower and upper brush-like bristles or fingers 124 extending toward each other from opposing longitudinal portions 126, 128 of the frame 120. FIG. 10A is an enlarged perspective view of a portion of the port 32B showing the brush-like fingers 124 in more detail. Referring to FIG. 10A, ends 130A of fingers 124B are embedded in the frame 126 and ends 130B of the fingers 124B extend towards the opposing frame 128. Fingers 124A extend partially across the port so that ends 132B of the fingers 124A, which extend from the opposing frame portion 128, overlap the ends 130B of the respectively opposing fingers 124B. The fingers 124A, 124B are preferably dense enough so that the overlapping end portions are in contact, as shown in FIG. 10B, which is a cross-sectional view of the port 32B of FIG. 8 taken along line 10B-10B in FIG. 10A. The port 32B includes multiple layers of the fingers 124A, 124B and, preferably, at least 4 to 6 layers of the fingers 124A, 124B. In the illustrative embodiment of the port 32B shown in FIGS. 10A and 10B, there are three layers each of the fingers 124A and 124B. In one embodiment of the port 32B, the frame 120 has depth D equal to about one-half (½) to one-quarter (¼) inches. The width W between the opposing frame portions 126 and 128 may be about 4-5 inches and the length of each finger 124 may be slightly more than half of the width (W). In addition, about one-eighth of an inch of the fingers 124 is embedded in the frame portions 126, 128. The fingers 124 may comprise a stiff polymer, such as neoprene, PVC or PMA, for example.

Figure 11A:
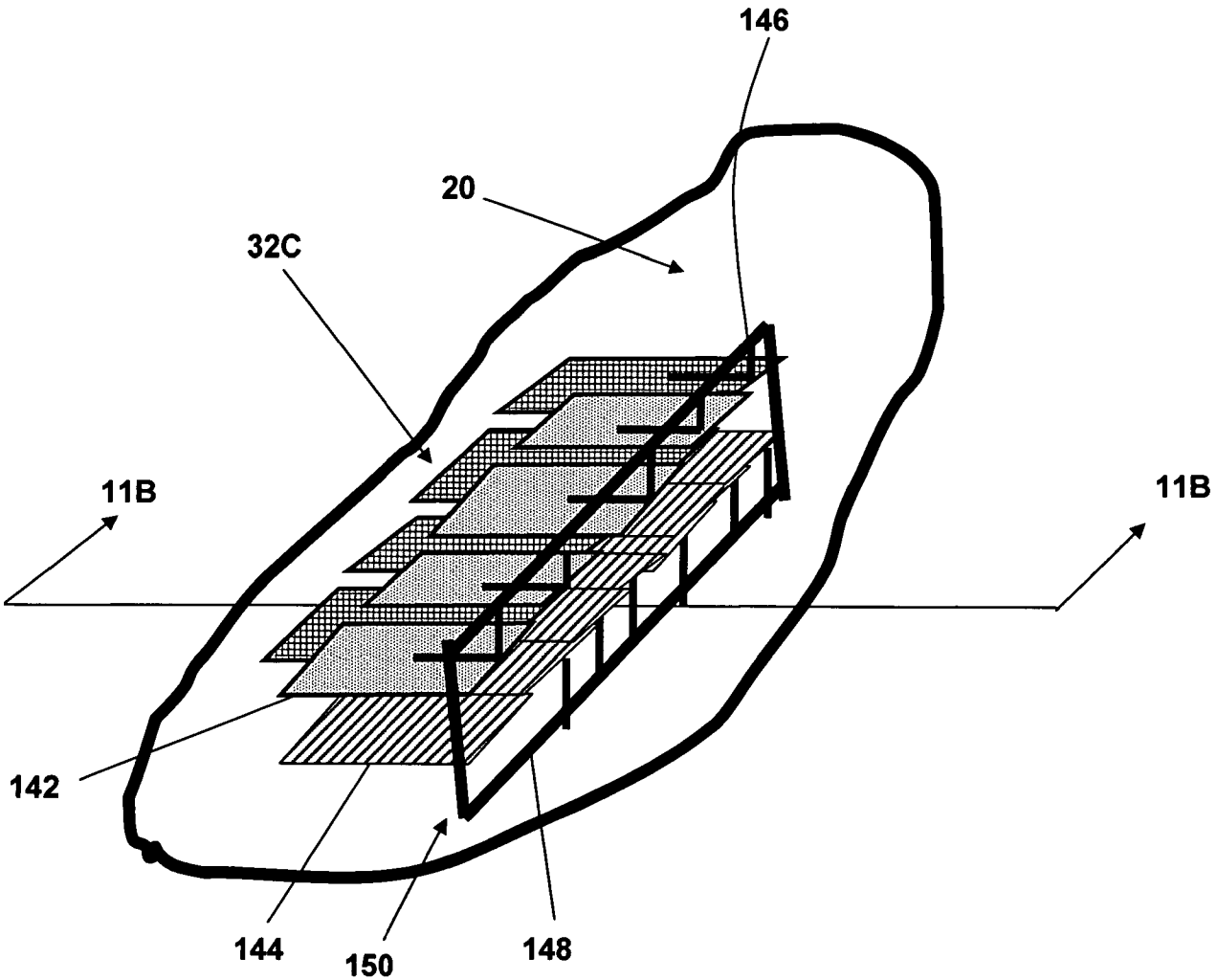
FIG. 11A is a perspective view of another embodiment of an access port including flaps for an isolation container in accordance with the present invention.
Figure 11C:
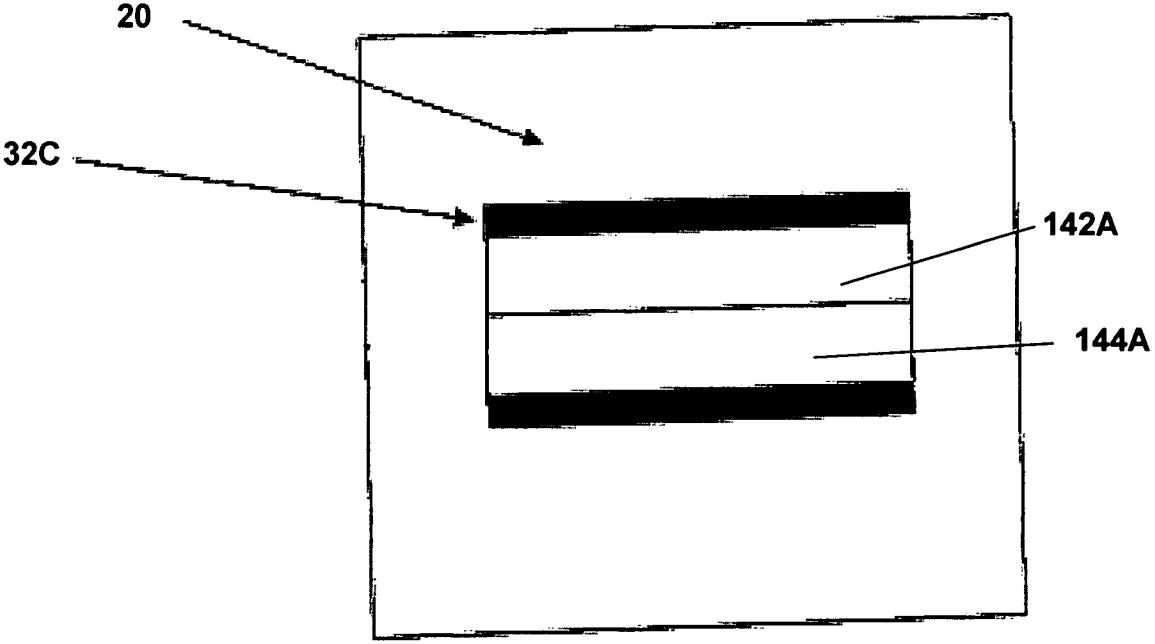
FIG. 11C is a front view of the access port of FIG. 11A.
Figure 11B:
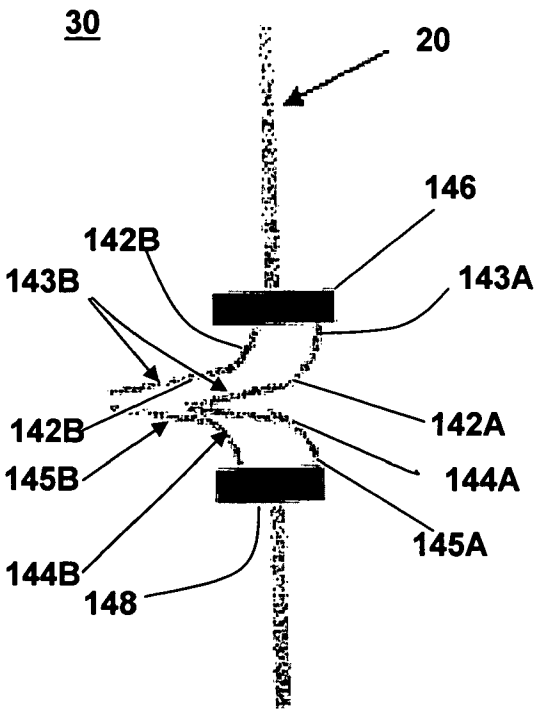
FIG. 11B is a cross-sectional view of the access port of FIG. 11A taken along line 11B-11B in FIG. 11A.

FIG. 11A illustrates another embodiment of an access port 32C for use in an isolation container in accordance with the present invention. Referring to FIG. 11A, the access port 32C is a longitudinally extending port including rows of longitudinally extending flaps 142A and 144A that are attached to and extend from longitudinal frame portions 146 and 148, respectively, of a frame 150. The frame 150 is made from the same or similar material as the frame 120, and attached to the wrap 20 in the same or a similar manner as the frame 120 is attached to the wrap 20, as described above. Referring to FIG. 11B, which is a cross-sectional view of the port 32C taken along line 11B-11B showing only the flaps 142A and 144A at the line 11B-11B, the flaps 142 have a portion 143A extending toward the frame 146 and a portion 143B bent inward, towards the isolation space 30. In addition, the flaps 144 have a portion 145A extending toward the frame 148 and a portion 145B bent inward, towards the isolation space 30. FIG. 11C is a front view of the port 32C showing only the upper and lower front flaps 142A and 144A.

The flaps 142, 144 may be of the same plastics as described above with respect to the fingers or other flexible polymeric materials. A plurality of layers of each of the flaps 142 and 144, such as 4 or more layers, is preferably provided, where only two rows of flaps 142A, 142B and 144A, 144B are shown in FIG. 11B for ease of illustration. The bent portions 143B, 145B of the flaps 142, 144, respectively, preferably bear against each other. The portions 143A, 145A of the flaps 142, 144 are preferably thicker than the portions 143B, 145B, and optionally may include a stiffener such as a piece of hard polymer, so that the portions 143A, 145A are more resistant to movement (bending) than the portions 143B, 145B. The portions 143A, 145A may be two to 3 times thicker than the portions 143B, 145B, for example.

Figure 12:
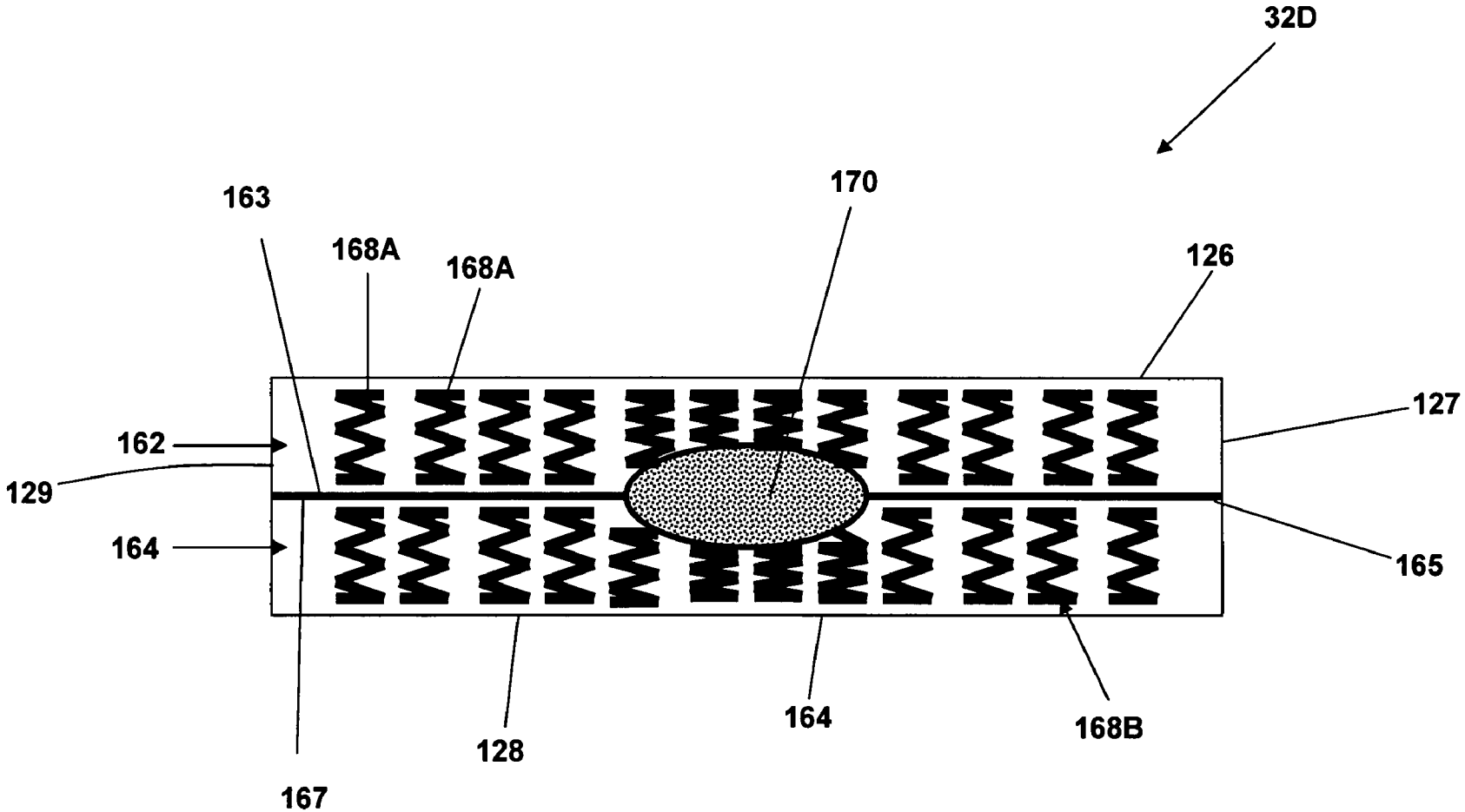
FIG. 12 is a front view of another embodiment of an access port including resilient members for an isolation container in accordance with the present invention.

FIG. 12 illustrates another embodiment of a continuous obstructed medical access port 32D for use in an isolation container, such as the isolation container 10, in accordance with the present invention. Referring to FIG. 12, the port 32D includes the frame 120 as in the port 32C, and upper and lower compartments 162 and 164 of fabric material that are attached to the portions 126 and 128, respectively, and extend toward each other to define an interface 165 between opposing portions 163, 167 of the respective compartments 162, 164. The compartments 162, 164 also are attached to end portions 127 and 129 of the frame 120. The compartments 162, 164 include at least one row of resilient members 168A, 168B, respectively, such as springs made from metallic wires or plastic. The resilient members 168A, 168B extend away from the longitudinal frame portions 126, 128, respectively, toward the opposing frame portion and are aligned so that individual members 168A, 168B oppose each other at the compartment portions 163, 167. Three to four rows of the resilient members 168, for example, may be provided across the depth D of the frame 120. The respectively opposing members 168A, 168B preferably contact the compartment portions 163, 167 at the interface 165 and slightly bear against each other through the opposing compartment portions 163, 167.

When a gloved hand is inserted at the interface 165 between the compartments 162, 164 and into the isolation space 30, an opening 170 about the size of the gloved hand is defined at the portion of the interface 165 where the gloved hand was inserted. In addition, the resilient members 168A, 168B in front of the hand are flexed and bent inward towards the interior space 30 substantially in the same manner that the flaps 142, 144 of the port 32C are bent inwards, as discussed above. The flexed members 168A, 168B bear against the compartment portions 163, 167 encircling the gloved hand, obstructing the port 32D at the opening 170. The members 168A, 168B not moved by the gloved hand continue to obstruct the port 32D at the portion of the interface 165 where the opening 170 is not defined. Individual ones, or groupings of, the members 168A, 168B may be contained within compartments attached to the portions 126 and 128 along with, or instead of, the upper and lower compartments 162, 164 which contain the members 168A, 168B. In one embodiment, string may also be used to maintain the resilient members 168A, 168B aligned to oppose each other. Alternatively, the opposing members 168A, 168B may be attached to the opposing frames 126 and 128 to maintain alignment between each pair of opposing resilient members 168A, 168B.

Figure 13A:
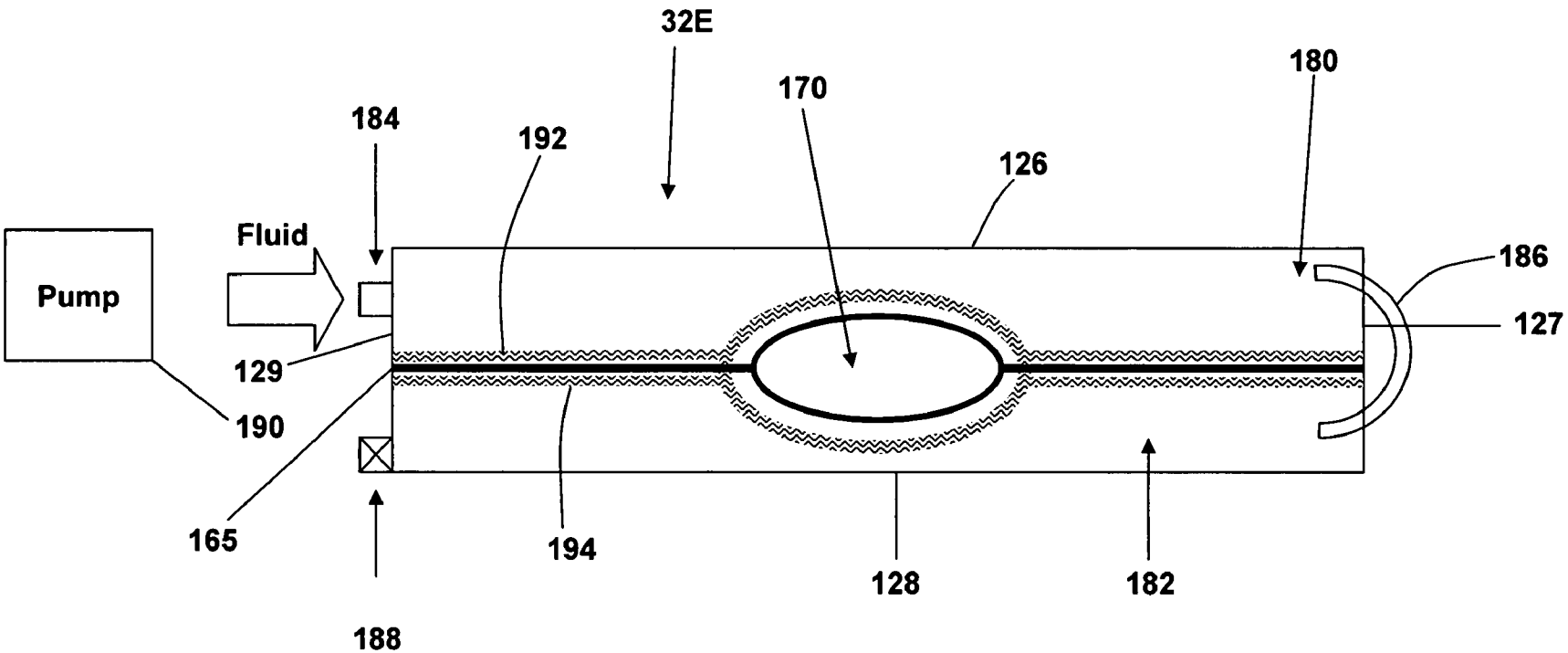
FIG. 13A is a front view of another embodiment of an access port including fluid filled membranes for an isolation container in accordance with the present invention.

In yet another embodiment, an access port 32E, as shown in FIG. 13A, is obstructed by a pair of balloon-like flexible membranes 180, 182 that extend from and are connected to the frame portions 126, 128, respectively, and are filled with a fluid, such as air. A fluid input port 184 is provided in one membrane, such as the upper membrane 180. A tube 186 provides fluid communication between the upper and lower membranes 180 and 182. A relief valve 188 is provided in the membrane 182. Air or another fluid is supplied to the input port 184, for example, by a pump 190. The pump 190 may be a separate pump or, alternatively, a pump included in the air management system 50 and which draws air through a filter as described in further detail below. The membranes 180, 182 are filled with enough air to obstruct the port 32E, blocking most air flow through the interface 165 between the membranes 180, 182, but providing enough flexibility to allow insertion of a gloved hand between the upper and lower membranes 180, 182 to define the opening 170. The membranes 180, 182 surround the hand, when inserted, thereby continuing to obstruct air flow through the port 32E. The membranes 180, 182 may be neoprene or silicone, for example. In addition, contacting surfaces 192, 194 of the membranes 180, 182, respectively, at the interface 165 may be shaped to allow a controlled amount of air flow between them when the access port 32E is not being used. The contacting surfaces 192, 194 may have any desired pattern, for example, a step or sawtooth pattern as shown in exaggerated form in FIG. 13A.

In an alternative embodiment, instead of the flexible membranes 180, 182, upper and lower pieces of foam rubber may be used, also with shaped contacting surfaces to allow some airflow.

Figure 13B:
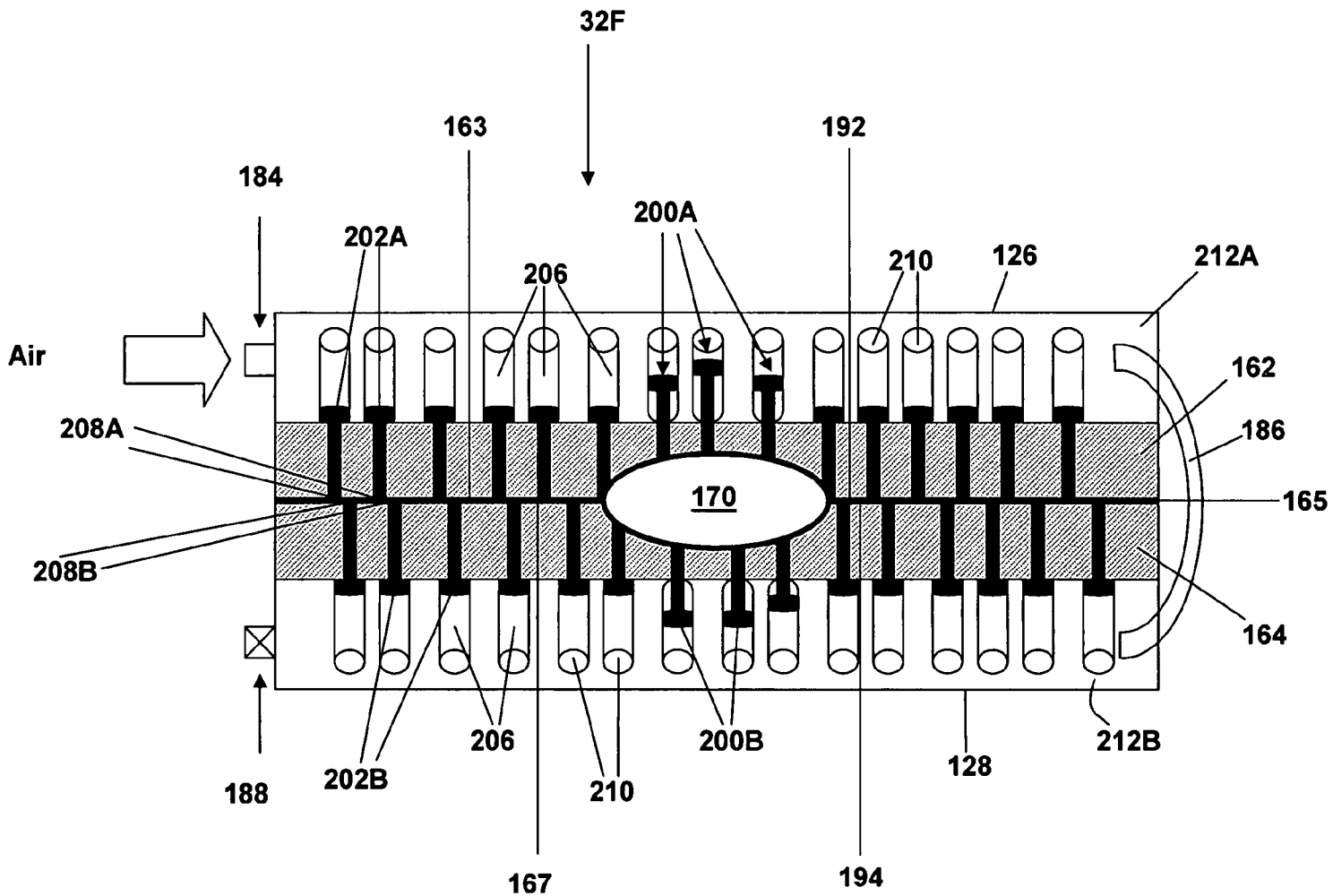
FIG. 13B is a front view of another embodiment of an access port including fluid filled compartments and plungers for an isolation container in accordance with the present invention.

FIG. 13B shows an embodiment of an access port 32F having a configuration related to the access port 32E of FIG. 13A and the access port 32D of FIG. 12. Referring to FIG. 13B, the access port 32F includes plungers 200A, 200B having ends 202A, 202B, respectively, within cylinders 206. The plungers 200A, 200B further include ends 208A, 208B, respectively, contained within compartments 162, 164 and opposing each other. The compartments 162, 164 are similar in construction to the membranes 180, 182, as described above. The opposing ends 208A, 208B of the plungers 200A, 200B contact the portions 163, 167, respectively, such that opposing external surfaces 192, 194 of the portions 163, 167 are in contact. The cylinders 206, which have open rear ends 210, are supported within manifolds 212A and 212B. The manifolds 212A, 212B are attached to the portions 126, 128 of the frame 120 and the compartments 162, 164, respectively. The manifold 212A includes a fluid input port 184, the manifold 212B includes a fluid output port 188 and a fluid communication tube 186 couples the manifold 212A to the manifold 212B. Air or other such fluids supplied from the port 184 are provided into the open ends 210 of the cylinders 206, under pressure.

Movement of a hand or arm through the interface 165 between the compartments 162, 164 pushes the plungers 200 in that region of the interface 165, in other words at the opening 170 defined in the interface 165, into the cylinders 206. The other plungers 200 adjacent to the opening 170 maintain the compartments 162, 164 in contact with each other at the opposing surfaces 192, 194, respectively. When the hand or hands are removed from the opening 170, the plungers 200 are pushed out of the cylinders 206 by air or fluid pressure within the cylinder 206, returning those portions of the flexible compartments 162, 164 previously defining the opening 170 back into a normal closed position where the opposing surfaces 192, 194 are in bearing contact with each other. As above, controlled leakage between the compartments 162, 164 is enabled by suitably shaping the compartments 162, 164 along their contacting surfaces 192, 194, at the portions 163, 167, respectively.

Figure 14:
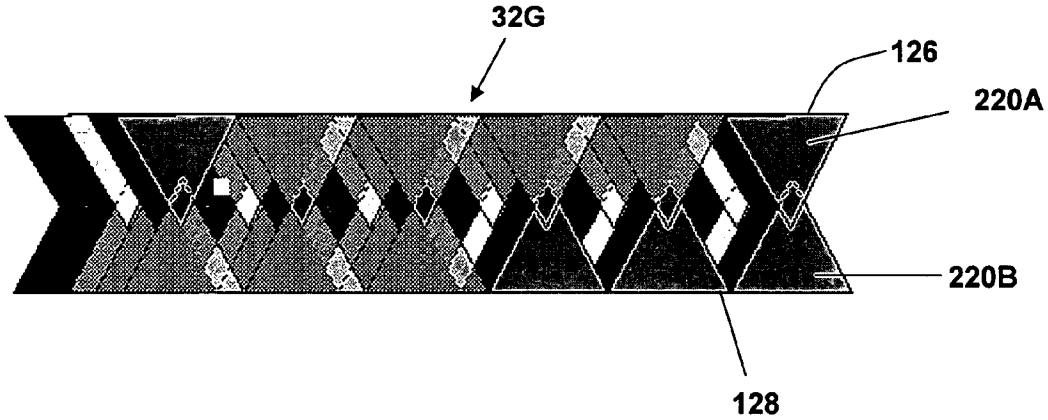
FIG. 14 is a front view of an embodiment of an access port having an iris valve configuration for an isolation container in accordance with the present invention.
Figure 15:
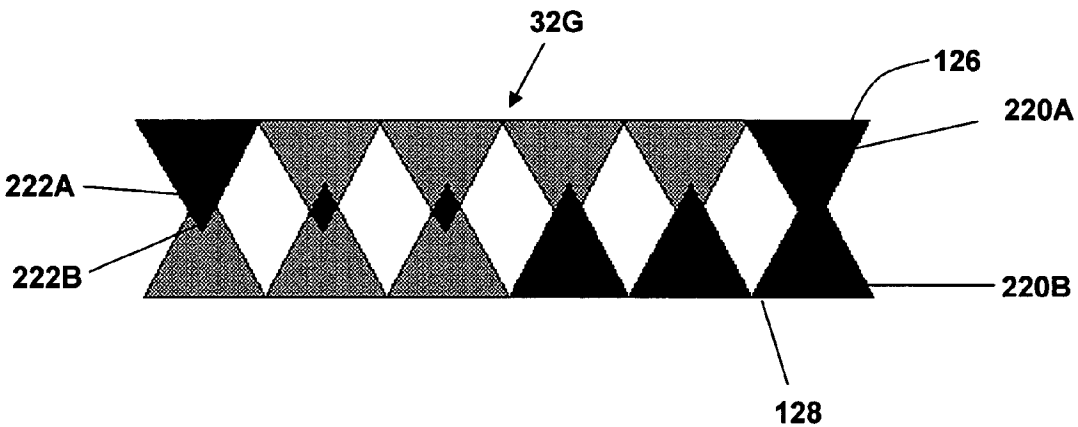
FIG. 15 is a front view of the iris valve configuration of the access port of FIG. 14 showing only a single layer of flaps.

In another embodiment, a continuous obstructed medical access port 32G for an isolation container in accordance with the present invention, as shown in FIG. 14, includes an iris valve-type structure for creating an obstruction. Referring to FIG. 14, the port 32G includes a plurality of layers of triangularly or otherwise shaped plastic flaps 220A, 220B secured to the upper and lower frame portions 126, 128, respectively, of the frame 120 that defines the port 32G. Referring to FIG. 14 and also to FIG. 15, the latter of which shows a single layer of the plastic flaps 220A and 220B at the port 32G, the flaps 220A of adjacent layers overlap and tips 222A, 222B of the respective opposing flaps 220A, 220B overlap. As shown in FIG. 14, multiple layers of the plastic flaps 220A having the same or similar arrangement are placed one on top of the other, with each layer offset with respect to another. The plastic flaps 220B have a multiple layer, offset arrangement similar to that of the layers of the flaps 220A. In the illustrative embodiment shown in FIG. 14, there are five (5) layers of each of the flaps 220A, 220B. Enough layers of the flaps 220A, 220 are preferably provided and the offset is such that there is no air hole (unobstructed passage) through the port 32G, when not in use.

Figure 16:
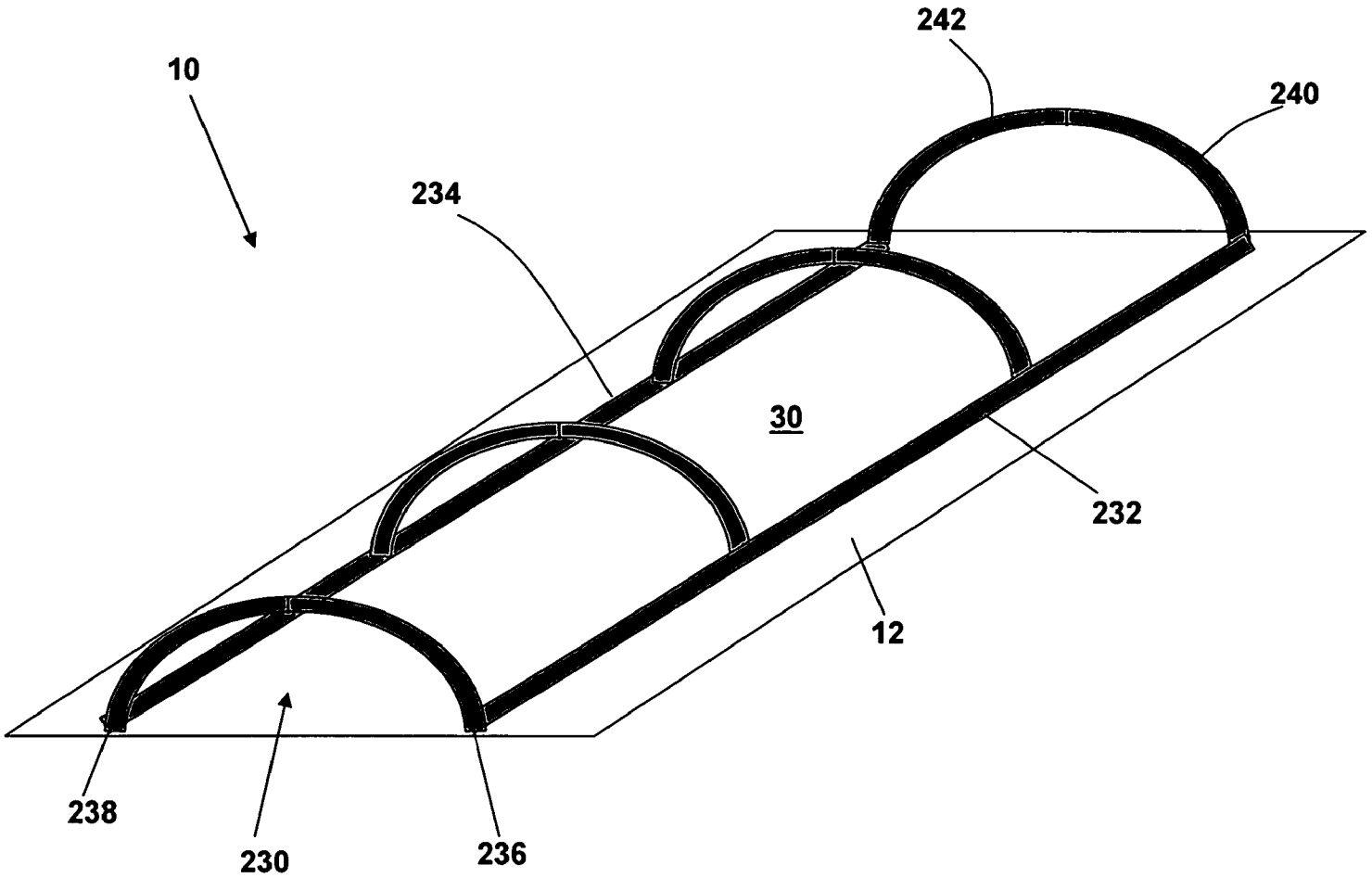
FIG. 16 is a perspective view of an embodiment of a supporting structure for a patient isolation container, in accordance with the present invention, disposed on a litter.

In a preferred embodiment, the isolation container 10 as illustrated in FIG. 1, includes a supporting structure 230 coupled to the litter 12, such as shown in FIG. 16, which is a perspective view of the container 10 of FIG. 1 including only the litter 12. Referring to FIG. 16, the supporting structure 230 provides a shape to the wrap 20 and prevents the wrap 20 from contacting the patient in the isolation space 30. In one embodiment, the supporting structure 230 is a flexible, inflatable tubing, as shown in FIG. 16. The tubing 230 includes right and left base tubing 232, 234 with air inlets 236, 238 coupled to right and left tubular arc portions 240, 242, respectively. The arc shaped tubing portions 240, 242 are connected to or contact the interior surface of the wrap 20 while the base tubing portions 232, 234 are connected to the litter 12. When deflated, the inflatable tubing support structure 230 is readily foldable for storage. When the base and arc portions 232, 234, 240 and 242 are inflated, the arc portions 240, 242 stand upright, supporting the right and left sides of the wrap 20, respectively. The patient may be placed on the litter 12 prior to inflating the tube portions 232, 234, 240 and 242. The patient may be removed from the litter 12 after deflating the tube portions 232, 234, 240 and 242. The litter 12 of the isolation container 10 may be discarded or decontaminated and folded for storage after use.

In an alternative embodiment, the supporting structure 230 can be used with an isolation container in accordance with the present invention that is adapted for transporting a patient in connection with a conventional litter, where the litter is a separate component that is not a part of the container 10.

Figure 17A:
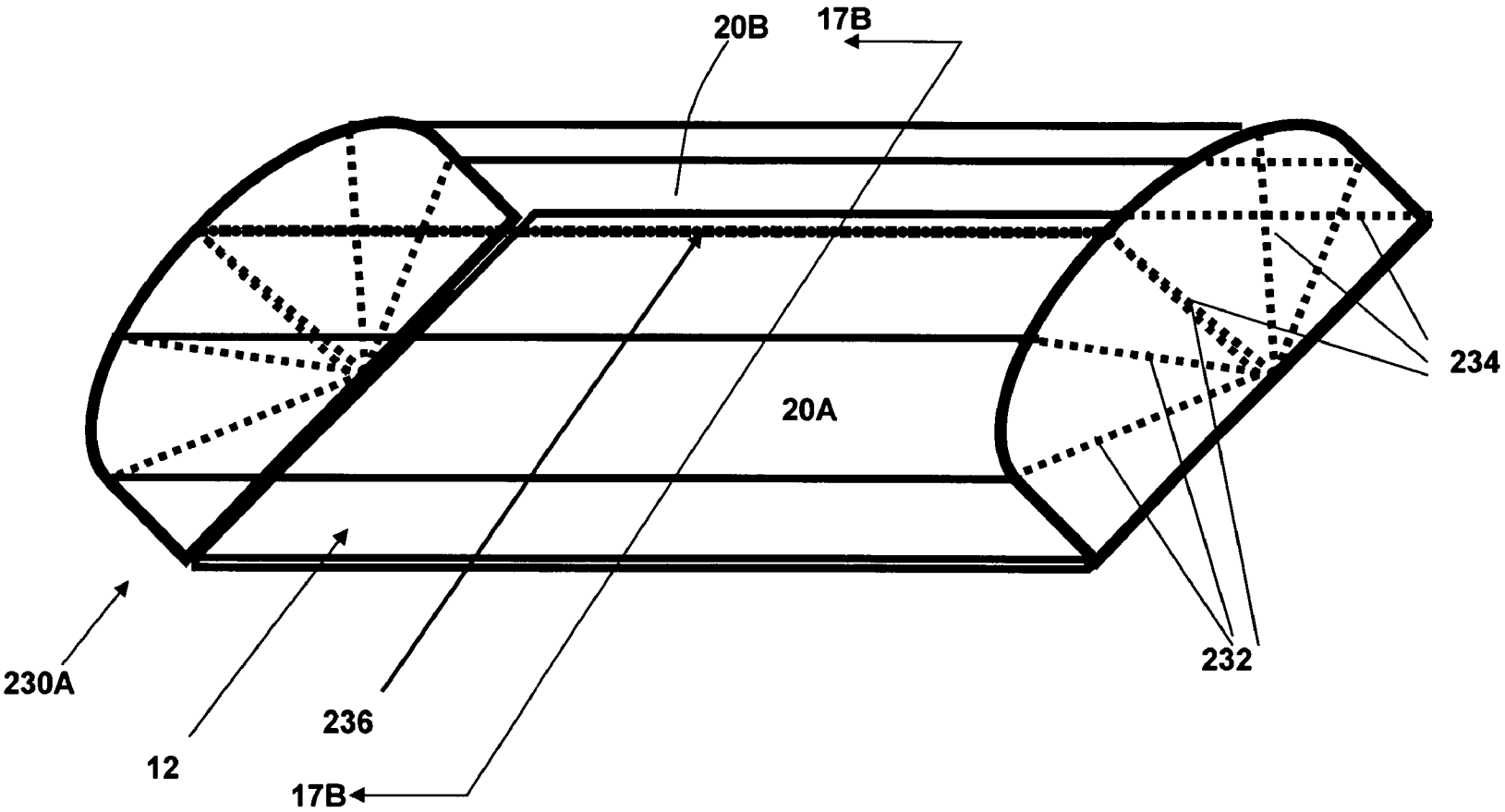
FIG. 17A is a perspective view of an embodiment of a double-clam shell supporting structure for a patient isolation container, in accordance with the present invention, disposed on a litter.

FIG. 17A shows another embodiment of a supporting structure 230A having a double clam shell configuration and which is for use in connection with the isolation container 10 in accordance with the present invention. Referring to FIG. 17A, the supporting structure 230A includes a set of solid or tubular rods 232 that support one-half 20A of the wrap 20, and another set of rods 234 that support other half 20B of the wrap 20 when the wrap 20 is in use. The two wrap halves 20A, 20B may be connected by a zipper or other such connection mechanism 236 in the center of the wrap 20, as discussed above, for example.

In an alternative embodiment, the supporting structure of the inventive isolation container 10 has a single clam shell configuration including supporting rods that extend across the wrap 20 and a C-shaped entry/exit slit is provided.

Figure 17D:
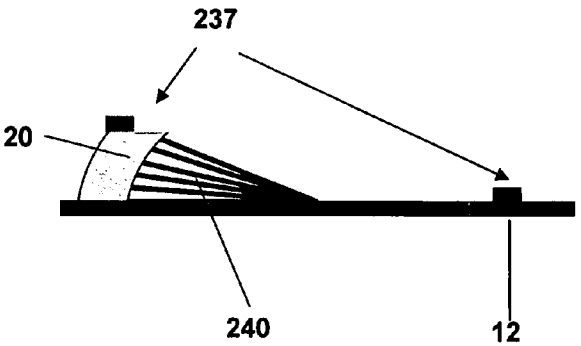
FIG. 17D is a cross-sectional view of an embodiment of a single-clam shell supporting structure for a patient isolation container, in accordance with the present invention, disposed on a litter in an open position.
Figure 17E:
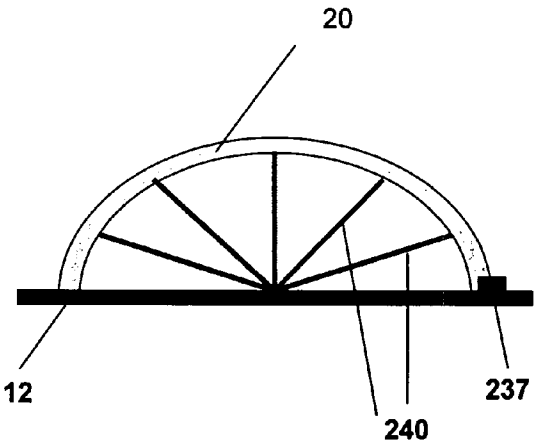
FIG. 17E is a reproduction of FIG. 17D with the supporting structure in a closed position.
Figure 17B:
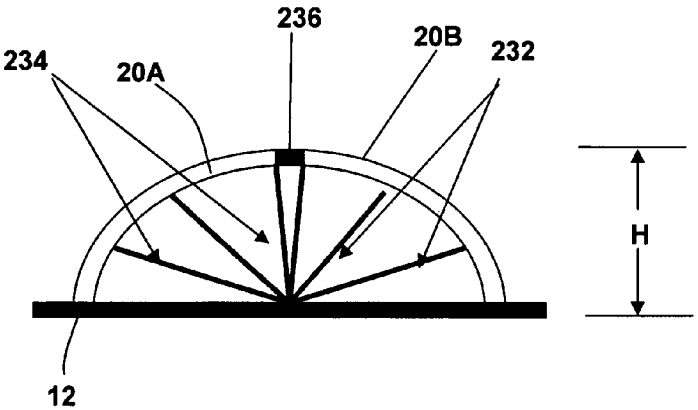
FIG. 17B is a cross-sectional view of the double-clam shell supporting structure for the patient isolation container of FIG. 17A taken along line 17B-17B and with the supporting structure in a closed position.
Figure 17C:
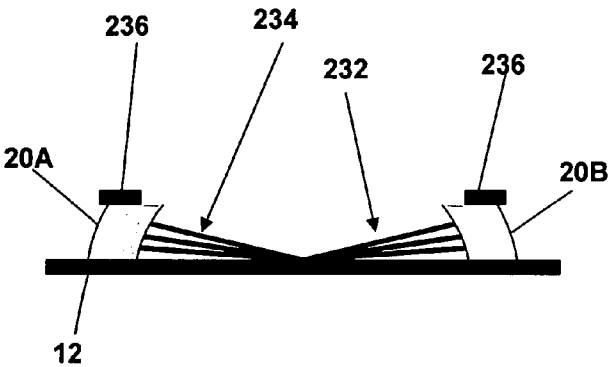
FIG. 17C is a reproduction of FIG. 17B with the supporting structure in an open position.

FIGS. 17B and 17C are end views of an exemplary embodiment of a patient isolation container including a double clam shell supporting structure in closed and open positions, respectively. FIGS. 17D and 17E are end views of an exemplary embodiment of a patent isolation container including a single clam shell supporting structure in open and closed positions, respectively. As discussed below with reference to FIGS. 17B, 17C, 17D and 17E, the inventive patient isolation container, including either the single or double clam shell supporting structure for the wrap, is readily foldable for storage, as well.

Referring to FIG. 17B, to remove a patient from a patient isolation container having the double clam shell support structure attached to or on the litter 12, the wrap 20 is opened at the connection mechanism 236. The right side 20B of the wrap 20 and the rods 232 are rotated clockwise and the left side 20A of the wrap and the rods 234 are rotated counterclockwise, away from each other, to lie flat, as shown in FIG. 17C, so that a patient may be readily removed. After positioning a patient onto the litter 12 having the double clam shell supporting structure, the sides of the wrap 20A, 20B are rotated upward so that the wrap 20 may be zipped or otherwise closed at the connection mechanism 236, as shown in FIG. 17B.

Referring to FIG. 17D, to remove a patient from the litter 12 including a single clam shell support structure, the wrap 20 is rotated counterclockwise to open connection mechanism 237, which is attached to a longitudinal edge of the wrap 20 and the litter 12, and also the support rods 240 are rotated counterclockwise. Referring to FIG. 17E, to isolate the patient in the isolation space 20, the rods 240 are rotated clockwise and the wrap 20 is rotated over the rods 240 and attached to the litter 12 at the connection mechanism 237. As above, the litter 12 may be discarded or decontaminated and folded for storage.

Figures 18A, 18B:
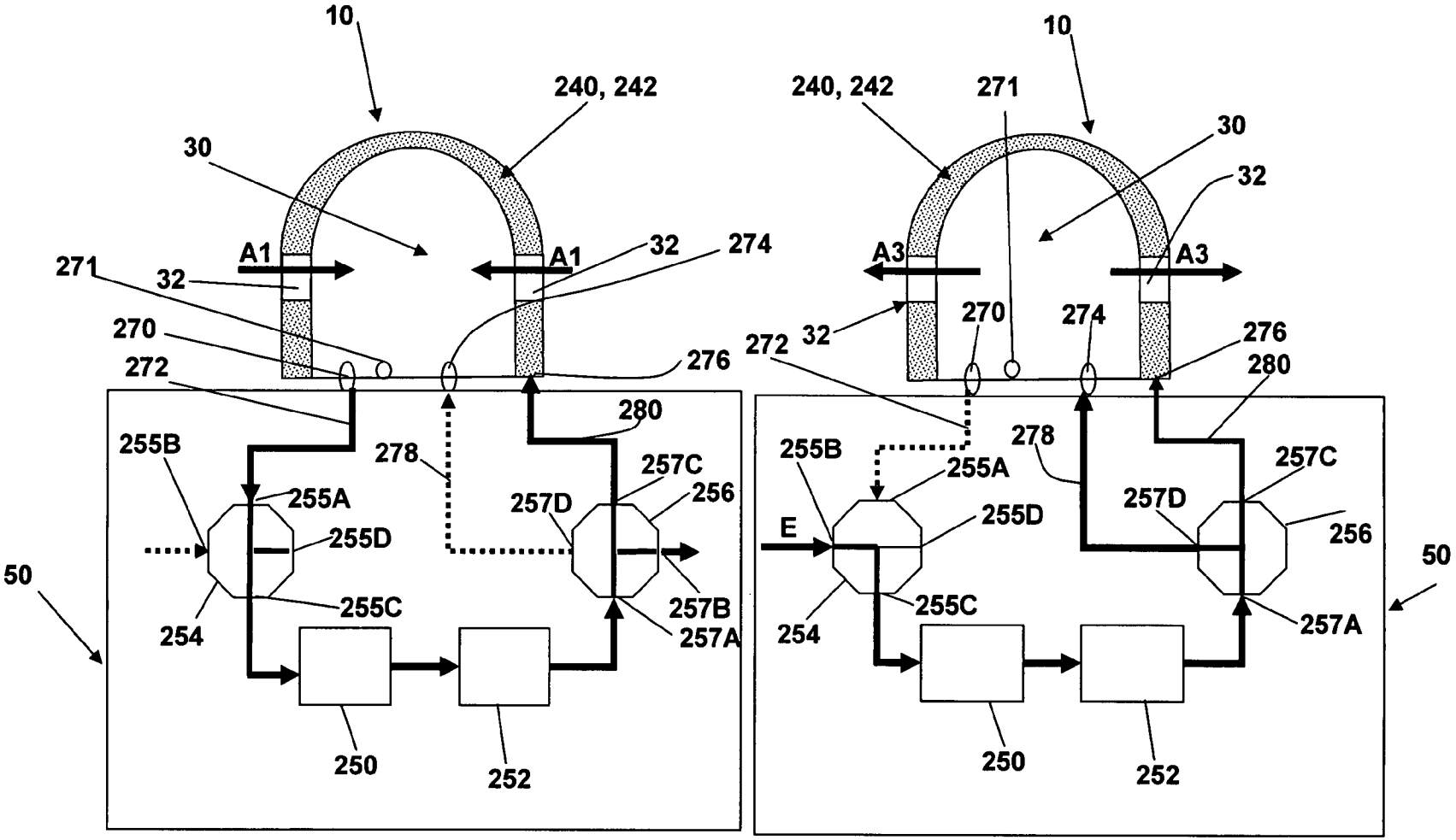
FIGS. 18A and 18B are functional block diagrams of an air pressure management system coupled to an embodiment of a patient isolation container, in accordance with the present invention, and operating in a negative pressure mode and positive pressure mode, respectively.

FIGS. 18A and 18B illustrate exemplary embodiments of the air pressure management system 50 coupled to the inventive patient isolation container 10 and configured for creating a desired negative and positive pressure, respectively, in the isolation space 30 of the container 10, where the container 10 is shown in transverse, cross-section and including only selected components to highlight the interconnections between the system 50 and the isolation space 30. Referring to FIGS. 18A and 18B, the isolation container 10 includes the inflatable tubes 240, 242, such as discussed above in the text accompanying the description of FIG. 16, for supporting the wrap 20 (not shown). The air pressure management system 50, which provides for re-circulation of air through the isolation space 30 as discussed below, includes an air processing device 250, a pump 252, a return 3-way valve 254, which includes ports 255A, 255B, 255C and 255D, and a supply 3-way valve 256, which includes ports 257A, 257B, 257C and 257D. The air processing device 250 couples the input of the pump 252 to the port 255C of the return valve 254. The output of the pump 252 is coupled to the port 257A of the valve 256. The ports 255A and 257D are for coupling to the isolation space 30, and in the illustrated embodiment constitute return and supply ports, respectively. The ports 255B and 257B are for communicating to the external environment, and in the illustrated embodiment constitute external air intake and exhaust ports, respectively. In the embodiment illustrated in FIGS. 18A and 18B, the port 255D is blocked (unused).

The air processing device 250 filters the re-circulating air flowing from the port 255C to the input of the pump 252, and preferably includes an air decontamination device that captures, contains and neutralizes biological agents in air, such as viruses, bacteria and spores, and removes airborne particles from air, such as soot and smoke. The air decontamination device comprises a filter mechanism, such as a HEPA filter. In a preferred embodiment, the air processing device 250 comprises ultraviolet ("UV") lamps upstream and downstream of the device 250 and reflectors positioned to reflect UV radiation directed away from the filter, towards the filter, so that fiber media of the upstream and downstream sides of the device 250 is completely illuminated with radiation. The air decontamination device may be a V-bank HEPA filter and the UV lamps may be positioned within regions defined by the V's, as shown and described in U.S. application Ser. No. 11/089,795 filed Mar. 25, 2005, U.S. application Ser. No. 10/434,041 filed May 8, 2003, and PCT publication WO 2004/011041 A2 published Feb. 5, 2004, each of which is assigned to the assignee of the present invention and is incorporated by reference herein. It is noted that other types and configuration of filters may be used as the filter in the air processing device 250.

The air processing device 250 optionally further includes temperature and moisture detection capabilities that detect, and generate data representative of, the temperature and level of moisture in air. Further, the device 252 is preferably coupled, by hardwire or wirelessly, to a temperature and moisture sensor 271 positioned in the isolation space 30. The sensor 271 is a conventional device that detects temperature and moisture in air and generates, and optionally wirelessly transmits, data representative of the detected temperature and moisture levels. In addition, the device 250 includes air heating, cooling, humidification and dehumidification capabilities ("climate control components"), as conventionally known in the art. The air processing device 250 also includes a controller for processing temperature and moisture data and then controlling the climate control components, as conventionally known in the art, to heat, cool, humidify and/or dehumidify the air to be routed to the valve 256 for maintaining the temperature and humidity within the isolation space 30 at desired levels.

In a further preferred embodiment, the controller of the device 250 includes alarms for indicating detection of temperature or moisture level of the air flow, back pressure at the pump 252 or electrical power being supplied to the device 250 that is at, above or below a predetermined level. For example, the alarms may include conventional audio and visual indicators.

The pump 252 is a conventional blower that, in a preferred embodiment, moves about 5-6 cubic feet of air per minute to provide at least about 12 air exchanges (at 0.01 inches water column) in one hour for the isolation container 10 having the above stated preferred dimensions, in accordance with Centers for Disease Control ("CDC") guidelines for airborne infectious isolation rooms. In an alternative embodiment, the pump 252 is a part of the device 250. The device 250 and/or the pump 252 may be positioned in the compartment 24, as shown in FIG. 1, for example, during operation.

Referring again to FIGS. 18A and 18B, a tube 272 couples the port 255A of the valve 254 to an air return port 270 in the isolation space 30. A tube 278 couples the port 257D of the valve 256 to an air supply port 274 in the isolation space 30. The return and supply ports 270, 274 may be provided through the litter 12 or the compartment 24, for example. A tube 280 couples the port 257C of the valve 256 to an air inlet port 276, which is coupled to the ports 236, 128 of the support structure 230 as shown in FIG. 16.

Referring to FIG. 18A, the system 50 is configured to generate a negative pressure within the isolation space 30 by routing air withdrawn from the space 30 via the tube 272, through the ports 255A and 255C of the valve 256 and then into the air processing device 250. The valve 256 is oriented so that air entering the port 255A flows through the valve 254 and only out the port 255C to the air decontamination device 250. The pump 252 draws in the air processed by the device 250 and then pushes the processed air into the port 257A of the valve 256. The valve 256 is oriented so that some of the air received from the pump 252 is exhausted to the external environment at the port 257B, and some of the air received from the pump 252 passes through the valve 256, out the port 257C and then into the port 276 via the tube 280 for inflating the supporting tubes 240, 242 and also the tubes 232, 234 (not shown). In addition, during such operation of the system 50, some air A1 is drawn into the isolation space 30 through the medical access ports 32.

In order to maintain a negative pressure within the space 30, the system 50 provides that the pump 252 withdraws a greater volume of air from the isolation space 30 than the volume of air A1 entering the space 30 through the medical ports 32. The system 50 is operable to establish a negative pressure of at least −0.01 inches water column for the isolation space 30, also in accordance with CDC guidelines for airborne infectious isolation rooms. Establishment of a negative pressure, which mitigates the escape of air, is particularly useful when a patient with an infectious disease is within the space 30. Substantially all air exiting the isolation space 30 is drawn through the air processing device 250 and decontaminated. The isolation container 10, therefore, protects transporters and medical personnel, as well as the surroundings, from contamination from a patient isolated within the isolation space 30.

Referring to FIG. 18B, the system 50 is operable to generate a positive pressure within the isolation space 30. In such operation, the valve 254 is oriented so that the port 255A is disconnected from the port 270 and the port 255B is coupled only to the port 255C so that only external air E is drawn into the air processing device 250 and the pump 252 via the valve 254. The valve 256 is oriented so that some of the air provided at the port 257A from the pump 252 is supplied to the supporting tubes 240, 242 and also the tubes 232, 234 (not shown) via the port 257C, and some of is supplied to the isolation space 30 via the port 257D. The system 50 supplies air to the space 30 at the port 274 to create a positive pressure within the isolation space 30. Although some air A3 escapes from the isolation space 30 through the medical access ports 32, the pump 252 drives a greater volume of air into the space 30 than the volume of escaping air A3, thereby maintaining a positive pressure. In a preferred embodiment, the system 50 can establish a positive pressure of at least +0.01 inch water column in the container 10 having the preferred dimension recited above, in accordance with CDC guidelines for airborne infectious isolation.

Establishment of a positive pressure within the isolation space 30, which minimizes the entry of external air E into the space 30 through the access ports or other openings in the space 30 not coupled to the system 50, is particularly useful when the patient has a suppressed immune system. Essentially the only external air E that enters the isolation space 30 passes through the air processing device 250 and is decontaminated. Other external air E, which could contain infectious biological agents, is less likely to enter the isolation space 30, where the agents could infect the patient. The isolation container 10, therefore, protects the patient where the system 50 operates to create positive pressure, as shown in FIG. 18B.

In one embodiment, the valves 254 and 256 of the system 50 are adjustable, either manually or automatically through electronic control signals transmitted by, for example, a controller within the system 50, or the controller 52 (see FIG. 2). When the valves 254 and 256 are oriented in the negative pressure mode as shown in FIG. 18A, some of the air supplied to the valve 256 at the port 257A may be routed through the port 257D and back to the isolation space 30 via the supply port 274. For example, up to about 80% of the air withdrawn from the isolation space 30 and routed to the valve 256 could be directed to the supply port 274. As not all of the air withdrawn from the isolation space 30 is routed back to the space 30, a negative pressure is established in the isolation space 30. Such at least partial recycling of air withdrawn from the isolation space 30 may be desirable, for example, when the patient isolation container 10 is exposed to cold temperatures. By recycling some of the air withdrawn from the isolation space 30, where such withdrawn air has been warmed by the patient, back into isolation space 30 the temperature of the isolation space 30 is more readily maintained.

In another alternative embodiment, the system 50 is configured in the positive pressure mode, such as shown in FIG. 18B, and operated so that some air is withdrawn from the isolation space 30 at the return port 270, and the withdrawn air provided at the port 255A is combined in the valve 254 with external air E at the port 255B and then routed to the port 255C. In a preferred mode of operation of the valve 254, up to about 80% of the air exiting the port 255C of the valve 254 is from the isolation space 30 and the remainder is external air E. The additional air supplied to the isolation space 30 creates the desired positive pressure.

Figure 19B:
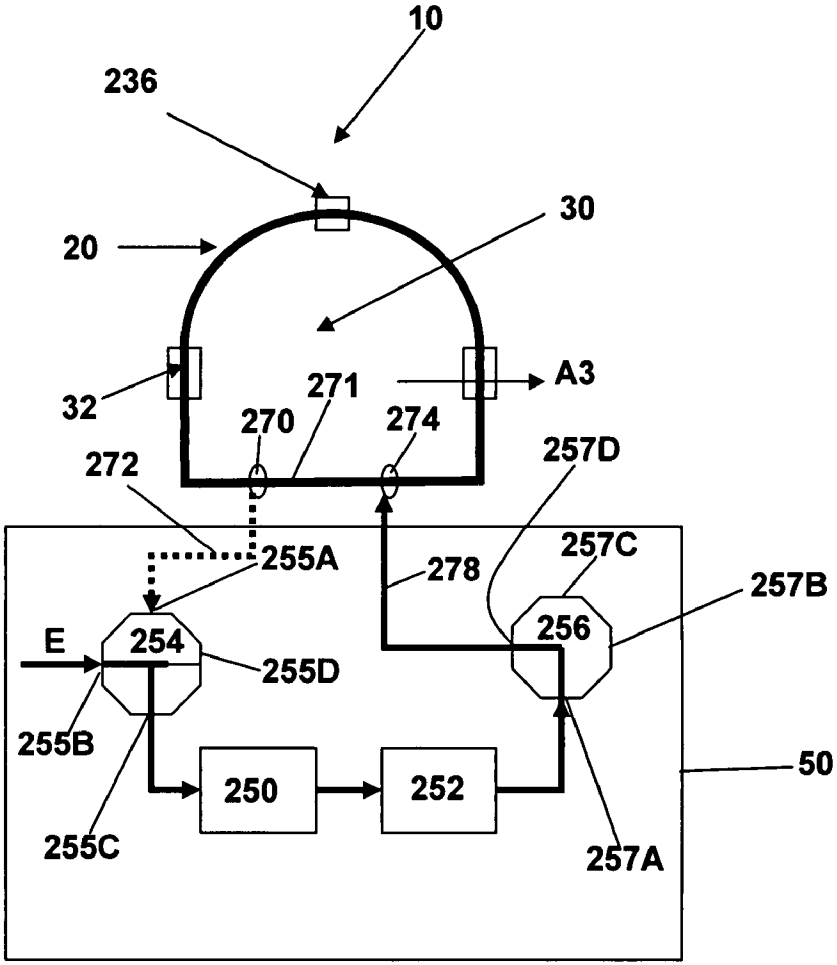
FIGS. 19A and 19B are functional block diagrams of an air pressure management system coupled to another embodiment of a patient isolation container, in accordance with the present invention, and operating in a negative pressure mode and positive pressure mode, respectively.
Figure 19A:
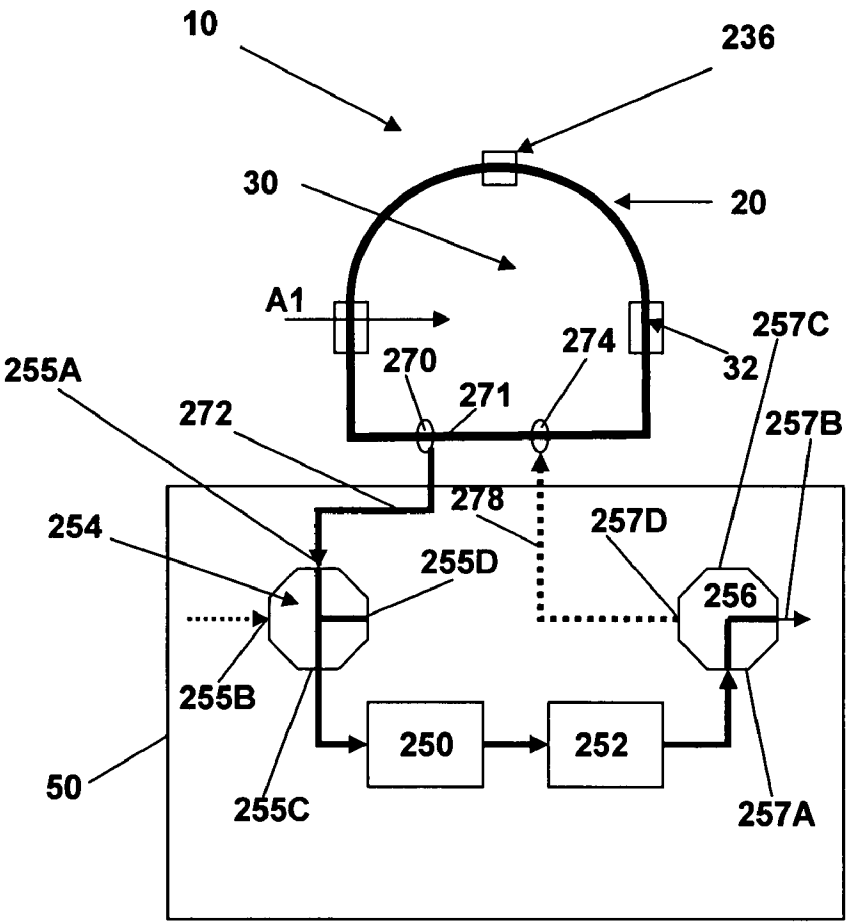

FIGS. 19A and 19B illustrate the exemplary air pressure management system 50 coupled to the container 10 and operating in this manner as described for FIGS. 18A and 18B, respectively, except that the container 10 includes the clam shell support structure 230A, as shown in FIG. 17A, instead of the inflatable support structure 230 of FIG. 16. Referring to FIGS. 19A and 19B, as there is no inflatable air support structure 230, the container 10 does not include the port 276. Referring to FIG. 19A, in the negative pressure mode the system 50 vents to the environment, at the port 257B of the valve 256, air that otherwise would have been provided to a port (276) of the container 10 for inflating the support tubes.

As discussed above with respect to FIGS. 18A and 18B, the valves 254 and 256 are preferably adjustable so that air withdrawn from the isolation space 30 may be recycled, which provides for maintaining the temperature within the isolation space 30, such as when the container 10 is exposed to cold temperatures.

Figure 20:
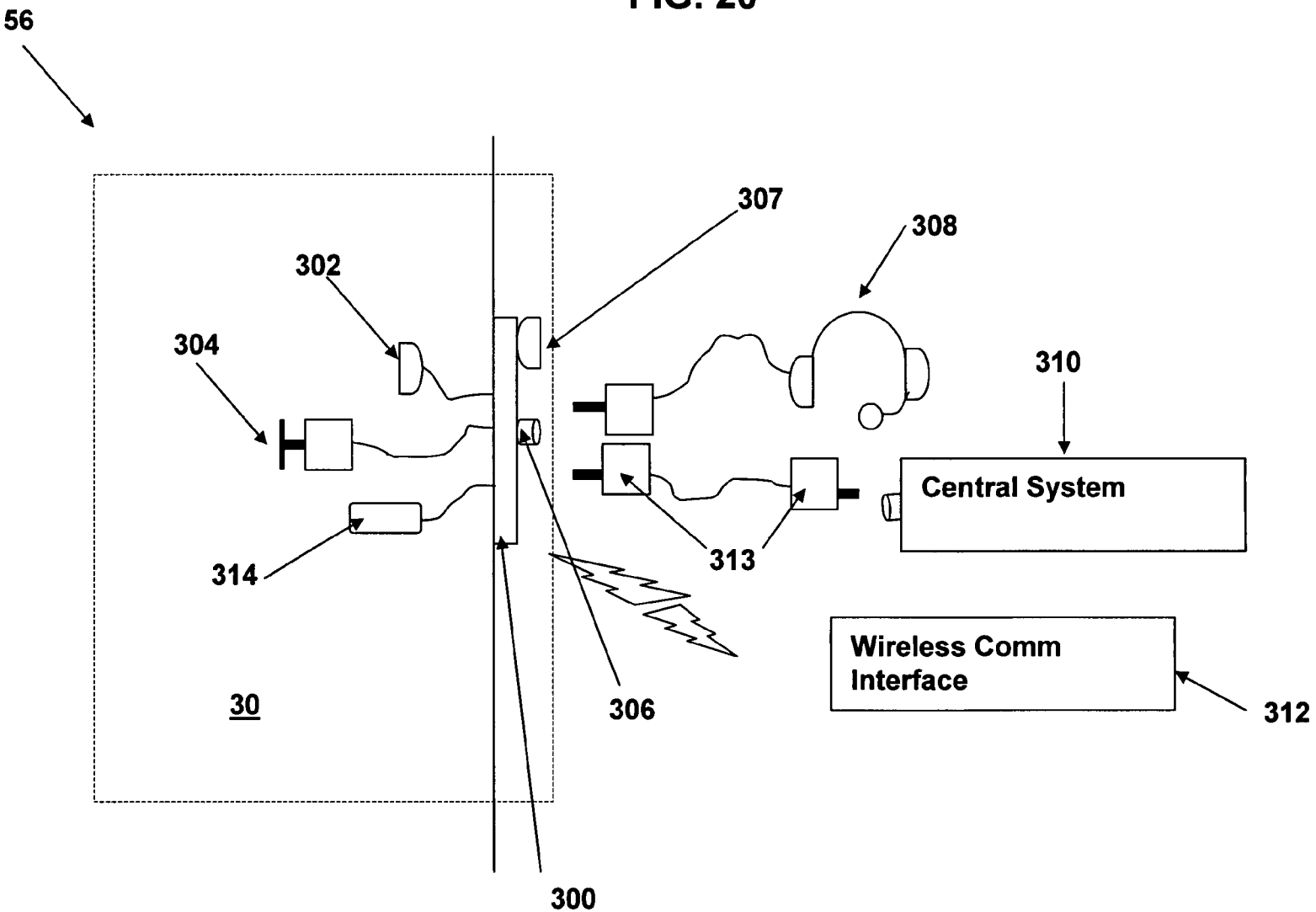
FIG. 20 is a functional block diagram of an embodiment of a communication system for a patient isolation container in accordance with the present invention.

FIG. 20 shows an exemplary embodiment of a communication system 56 coupled to the isolation space 30 of an isolation container, in accordance with the present invention, for facilitating communication between a patient within the isolation space 30 and an individual outside the space 30. For purposes of illustration, FIG. 20 shows exemplary components of the communication system 56 coupled to the isolation space 30 of the patient isolation container 10, as shown in FIG. 2. Referring to FIG. 20, the system 56 includes a controller 300 including a memory, processor and conventional wired, or optionally wireless, data transmitting and receiving capabilities. The controller 300 is located outside the isolation space 30, such as in the compartment 24 of the container 10 (see FIG. 1) or external to the container 10, and is coupled to an audio communications component 302, a manually operable alerting component 304, such as a medical push button call switch, and a video communications component 314. The components 302, 304 and 314 are located within the isolation space 30. The component 302 includes conventional audio data signal receiving and transmitting capabilities, and a conventional audible sound generator and detector, such as a speaker and microphone, respectively. The component 314 includes conventional video data receiving and transmitting capabilities, and a video signal generator and video display, such as a video camera and a LCD monitor, respectively. The component 304 is a conventional medical alerting communication box including, for example, push buttons and audible and visible, such as an LED, alarms. The controller 300 further includes data interface means 306, such as audio and video jacks and wired or wireless data ports, through which data can be transferred between the controller 300 and devices located outside the space 30, such as a conventional head set with speaker and a microphone 308 or a wireless communication interface 312. In a preferred embodiment, the interface means 306 is a male jack and an interconnect cable 313 having female jacks at both ends interconnects the means 306 to a central medical monitoring system 310 having a male interconnect jack. The controller 302 also includes an audio and video communication component 307 coupled to an external surface of the isolation space 30, and which preferably includes a microphone, speaker, camera and video monitor. The component 307 is operable in combination with the components 302 and 314, via the controller 300, to provide for a local communication link between the patient and a person in the immediate vicinity of the isolation space 30. The system 56 optionally includes one or more of the devices 308, 310 and 312.

The system 56, in operation, provides that the patient can speak with or see some outside the space 30, and vice versa, and that data concerning the patients contained in respective containers 10 can be collected at a remote location to permit centralization and organization of medical treatment being provided to the isolated patients Although preferred embodiments of the present invention have been described and illustrated, it will be apparent to those skilled in the art that various modifications may be made without departing from the principles of the invention.

What is claimed is:

1. A continuous access port for an isolation device, wherein the isolation device defines an isolation space and a gas management system coupled to the isolation device is operable to maintain the isolation space substantially isolated from an environment external to the isolation space, the continuous access port being an interface between the isolation space and the external environment and comprising:

a self-sealing connection mechanism; and at least one insertion port for providing continuous obstructed access to the isolation space, wherein the insertion port is movably coupled to the self-sealing connection mechanism and the self-sealing connection mechanism is self-sealing to itself and the insertion port responsive to movement of the insertion port, wherein the insertion port includes a flexible interface element adapted such that, when an insertion item extends through the flexible interface element of the insertion port and into the isolation space, the insertion item is maneuverable within the insertion port and the isolation space in six degrees of freedom and the flexible interface element of the insertion port is maintained in contact with the insertion item to obstruct flow of gas into and out of the isolation space.

2. The continuous access port of claim 1, wherein the flexible interface element of the insertion port is an iris valve including a plurality of flexible layers of polymeric material.

3. The continuous access port of claim 1, wherein the self-sealing connection mechanism includes a zipper means coupled to the insertion port.

4. The continuous access port of claim 1, wherein, when the insertion port is moved, the self-sealing connection mechanism self-seals at a location from which the insertion port moved.

5. The continuous access port of claim 1, wherein the self-sealing connection mechanism includes a movable zip-locking mechanism coupled to the insertion port.

6. The continuous access port of claim 1, wherein the self-sealing connection mechanism includes a movable hook and loop fastening mechanism coupled to the insertion port.

7. A continuous access port for an isolation device, wherein the isolation device defines an isolation space which is maintainable substantially isolated from an environment external to the isolation space, the continuous access port being an interface between the isolation space and the external environment and comprising:

a self-sealing connection mechanism; and at least one insertion port for providing continuous access to the isolation space, wherein the insertion port is movably coupled to the self-sealing connection mechanism and the self-sealing connection mechanism is self-sealing to itself and the insertion port responsive to movement of the insertion port, wherein the insertion port is adapted such that, when an insertion item extends through the insertion port and into the isolation space, the insertion item is maneuverable in six degrees of freedom.

* * * * *